US005842929A

United States Patent [19]

Moody et al.

[11] Patent Number: 5,842,929

[45] Date of Patent: Dec. 1, 1998

[54] BOWLING SCORING SYSTEM WITH INSTANT REPLAY

[75] Inventors: Erick R. Moody, Grandville; William Sias, Muskegon; David MacPherson, Muskegon; Thomas G. Phee, Muskegon, all of Mich.

[73] Assignee: Brunswick Bowling & Billiards Corporation, Muskegon, Mich.

[21] Appl. No.: 697,870

[22] Filed: Aug. 30, 1996

Related U.S. Application Data

[60] Provisional application No. 60/020,403 Jun. 25, 1996.

[51] Int. Cl.[6] ..... A63F 9/22

[52] U.S. Cl. ..... 473/70

[58] Field of Search ..... 473/101, 70, 69, 473/67, 64, 58, 54; 364/410, 411; 348/579, 157; 340/323 B; 434/249

[56] References Cited

U.S. PATENT DOCUMENTS

| | | | |
|---|---|---|---|
| 3,252,705 | 5/1966 | Cornberg . | |
| 4,247,100 | 1/1981 | Barbee . | |
| 4,893,182 | 1/1990 | Gautraud et al. | 348/579 |
| 5,101,354 | 3/1992 | Mowers et al. . | |
| 5,118,105 | 6/1992 | Brim et al. | 475/54 X |
| 5,241,379 | 8/1993 | Tsujita | 348/157 |
| 5,618,238 | 4/1997 | Kruse et al. | 473/70 |

*Primary Examiner*—Jessica Harrison
*Assistant Examiner*—Michael O'Neill
*Attorney, Agent, or Firm*—Price, Heneveld, Cooper, DeWitt & Litton

[57] ABSTRACT

An instant replay system for a bowling scoring system is disclosed in which a video clip of a bowler's approach and deliver of a bowling ball and a video clip of the bowling ball subsequently entering a pin-fall area are filmed, compressed, and stored in a memory device, such as a hard drive. The instant replay system includes a controller for receiving user requests from a user input terminal of the bowling scoring system and for responding to such user requests by selecting a stored video clip and controlling playback of the selected video clip on a display monitor of the bowling scoring system. In this manner, a user may request that the replay video clip be played in at any selected rate, that the controller freeze the display on a specific video frame, and that the controller fast-forward or rewind the video clip. Further, the user may request the replay of any previously stored video clip by specifying the bowler, game, frame and ball of which the video clip is taken. The instant replay system may be networked to similar systems associated with other lanes of the bowling center and networked to a shared video server. The video server may transfer any one or more requested video clip to a VCR for transfer to a video tape at the request of a user entered at a scoring console. Further, the video server may transfer a selected video frame to a printer in response to a user's request.

61 Claims, 15 Drawing Sheets

20
26
26
26
26
12
12
12

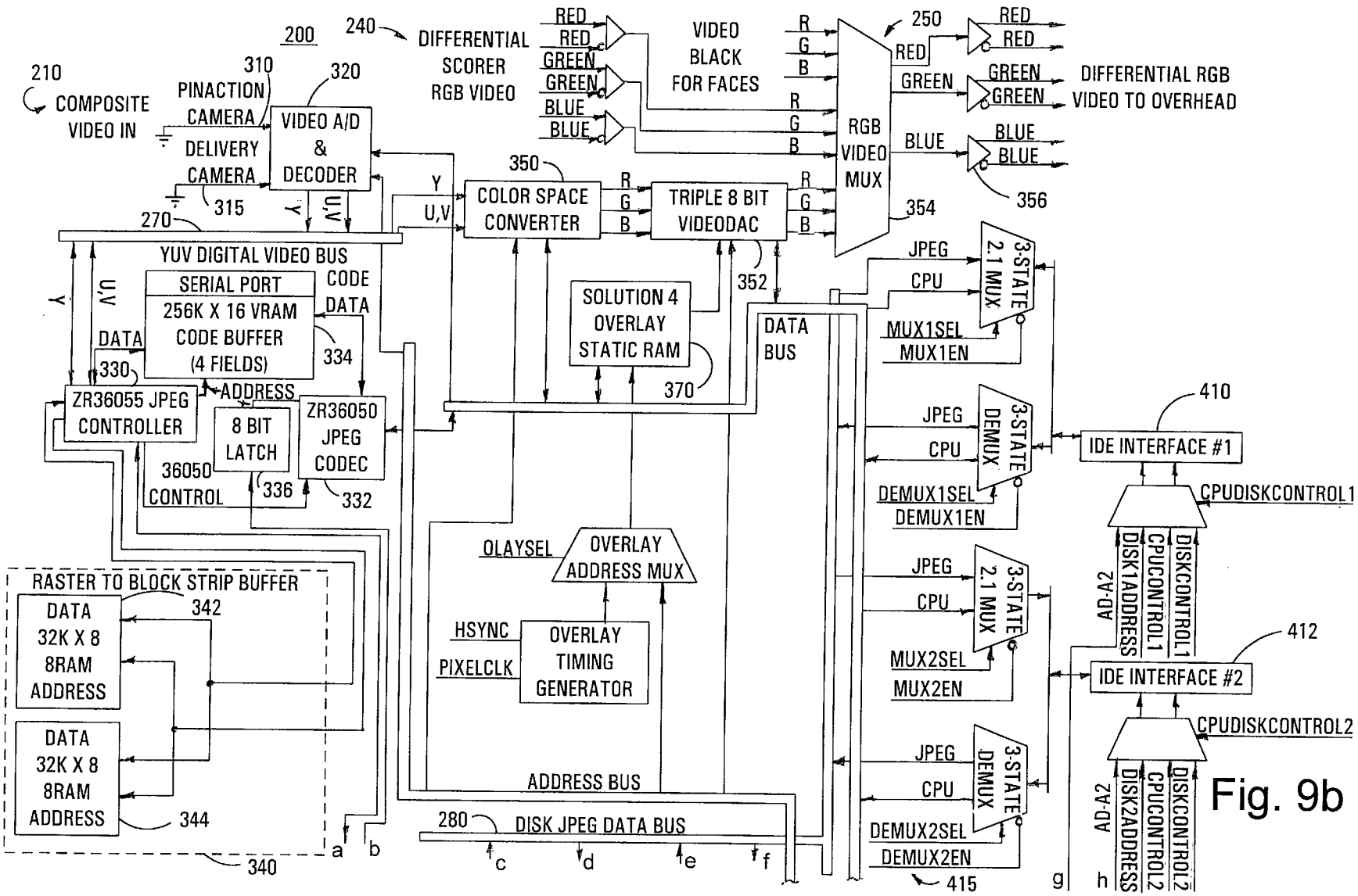
Fig. 9b
DIFFERENTIAL RGB VIDEO TO OVERHEAD
RED
GREEN
BLUE
356
250
354
RGB VIDEO MUX
R G B
VIDEO BLACK FOR FACES
352
TRIPLE 8 BIT VIDEODAC
370
SOLUTION 4 OVERLAY STATIC RAM
350
COLOR SPACE CONVERTER
DIFFERENTIAL SCORER RGB VIDEO
240
200
320
VIDEO A/D & DECODER
310
PINACTION CAMERA
DELIVERY CAMERA
315
270
COMPOSITE VIDEO IN
210
Y
U,V
YUV DIGITAL VIDEO BUS
CODE
DATA
334
SERIAL PORT
256K X 16 VRAM CODE BUFFER (4 FIELDS)
ADDRESS
ZR36050 JPEG CODEC
332
8 BIT LATCH
336
36050 CONTROL
ZR36055 JPEG CONTROLLER
330
DATA BUS
JPEG
CPU
MUX1SEL
MUX1EN
3-STATE 2.1 MUX
DEMUX1SEL
DEMUX1EN
3-STATE DEMUX
MUX2SEL
MUX2EN
DEMUX2SEL
DEMUX2EN
415
410
IDE INTERFACE #1
CPUDISKCONTROL1
DISKCONTROL1
CPUCONTROL1
DISK1ADDRESS
AD-A2
412
IDE INTERFACE #2
CPUDISKCONTROL2
DISKCONTROL2
CPUCONTROL2
DISK2ADDRESS
OVERLAY ADDRESS MUX
OLAYSEL
OVERLAY TIMING GENERATOR
HSYNC
PIXELCLK
ADDRESS BUS
DISK JPEG DATA BUS
280
a b c d e f g h
340
RASTER TO BLOCK STRIP BUFFER
342
344
DATA 32K X 8 8RAM ADDRESS

BOWLING SCORING SYSTEM WITH INSTANT REPLAY

CROSS-REFERENCE TO RELATED APPLICATIONS

This application claims priority under 35 U.S.C.§ 119(*e*) on U.S. Provisional Application Ser. No. 60/020,403 entitled BOWLING SCORING SYSTEM WITH INSTANT REPLAY, filed on Jun. 25, 1996, by Erick R. Moody, William Sias, David MacPherson, and Thomas G. Phee, the entire disclosure of which is incorporated herein by reference.

BACKGROUND OF THE INVENTION

Bowling scoring systems are known that have been used in conjunction with some form of an automated instant replay system. Such replay systems have substantially separate and independent replay systems that deliver the replay video to the scoring monitors of the bowling scoring system. Aside from sharing a common display monitor, the hardware and user interfaces of the bowling scoring system and the instant replay system are separate and independent from one another. Further, such prior instant replay systems record and playback only the bowler's approach and delivery, but do not record the pin-fall.

Conventional instant replay systems have used random access memory (RAM) as the sole means for storing the digitized video that is obtained from an approach area camera. Due to the large amount of memory that digitized video images consume and the high cost of RAM, these conventional instant replay systems typically store only the video obtained during the delivery of the most recently bowled ball. Thus, a user cannot retrieve the video of a ball rolled in a previous frame or game. Further, with the conventional instant replay systems, a bowler could not playback the video clip in slow motion or frame by frame nor could a bowler fast-forward or rewind the video segment, but rather, the bowler would have to watch the entire video segment from start to finish.

In addition, conventional instant replay systems do not allow for input of user commands using the user input portion of a scoring console. Thus, any input mechanisms for the instant replay system would be provided in addition to the keys of the scoring console. Further, any such user input mechanism has not allowed a user to manipulate the video in any manner or to adjust parameters of the video delivered to the display monitor, such as the brightness, color, contrast, etc., that are commonly only adjusted by adjusting the monitor. When the display monitors are mounted overhead and out of the reach of the bowlers, the problem is exacerbated.

Because the previous instant replay systems do not allow for the replay of video recorded in previous frames, a bowler that bowls a perfect game cannot review or transfer onto a video tape the recorded video for the entire game. Further, the prior systems do not allow for hard copy photographic images to be printed from the recorded video.

SUMMARY OF THE INVENTION

It is therefore an object of the present invention to provide an improved bowling scoring system with instant replay capabilities that overcome the above-noted problems. One aspect of the present invention is to provide a bowling scoring system that allows a user to send requests for instant replay of selected video segments using the scoring console provided as part of the scoring system. Another aspect of the invention is to provide an instant replay system for a bowling center that allows a user to instruct the system to control the instant replay with commands such as fast-forward, rewind, pause, stop, play normal, play in slow motion, freeze frame, advance frame by frame at different rates, etc., all by manipulating soft-keys on a user input terminal, which may be the scoring console of the bowling scoring system. To achieve these and other aspects and advantages, the instant replay system of the present invention comprises a video camera for generating video signals representing a video clip of at least a portion of a bowling ball rolled down a lane, storing means for receiving the video signals and storing the video clip, and a controller coupled to the user input terminal of the bowling scoring system for receiving a user request to replay a video clip and for transferring the video clip from the storing means to the display monitor to playback the video clip on the display monitor in response to the user request received from the user input terminal of the bowling scoring system.

Another aspect of the present invention is to provide an instant replay system that compresses replay video clips prior to storing the clips in memory such that a plurality of video clips may be stored and subsequently selectively displayed. To achieve this and other aspects and advantages, the instant replay system of the present invention comprises a video camera for generating video signals representing a video clip of at least a portion of a bowling ball rolled down a lane, compressing means for receiving the video signals and compressing the video clip, storing means for storing the compressed video clip, decompressing means for reading the compressed video clip from the storing means, decompressing the compressed video clip, and for supplying the decompressed video clip to the display monitor, and a controller coupled to the decompressing means and to the user input terminal for receiving a user request to replay a video clip and for controlling the decompressing means to read, decompress, and playback the video clip on the display monitor in response to the user request.

Yet another aspect of the present invention is to provide an instant replay system that allows a user to recall and replay video segments of rolled balls from previous frames or games. To achieve this and other aspects and advantages, the instant replay system of the present invention comprises a video camera for generating video signals representing a plurality of video clips, each video clip including a video image of at least a portion of a bowling ball rolled down a lane, storing means for receiving the video signals and storing each of the video clips in separately addressable memory locations, a user input terminal for receiving user requests to playback a selected one of the stored video clips, a display monitor for displaying the selected video clip, and a controller coupled to the display monitor, to the storing means, and to the user input terminal for receiving a user request to replay a selected video clip, for identifying the addressable memory location in the storage means corresponding to the selected video clip, and for transferring the selected video clip from the storing means to the display monitor to playback the selected video clip on the display monitor in response to the user request.

Still another aspect of the present invention is to provide an instant replay system that records the pin-falling action. To achieve this and other aspects and advantages, the instant replay system of the present invention comprises a pin-fall area video camera directed toward a pin-fall area of the lane so as to generate video signals representing a video clip of the pin-fall area as a bowling ball passes through the pin-fall area, storing means for receiving the video signals and storing the video clip, a display monitor for displaying the video clip, and a control circuit coupled to the display monitor and to the storing means for transferring a video clip from the storing means to the display monitor to playback the video clip on the display monitor.

A further aspect of the present invention is to provide an instant replay system that can transfer any recorded replay video segment or combination of segments to a video cassette recorder (VCR) video tape or other portable storage medium upon demand by a user. To achieve this and other aspects and advantages, the instant replay system of the present invention comprises a video camera for generating video signals representing a video clip of at least a portion of a bowling ball rolled down a lane, storing means for receiving the video signals and storing the video clip, an input terminal for receiving operator requests, transfer means for transferring a received video clip to a portable storage medium, and a control circuit coupled to the storing means, to the transfer means, and to the input terminal for transferring a video clip from the storing means to the transfer means for subsequent transfer to a portable storage medium in response to an operator request.

Another aspect of the present invention is to provide an instant replay system that can print a color image of a still frame from a recorded video segment upon demand. To achieve this and other aspects and advantages, the instant replay system of the present invention comprises a video camera for generating video signals representing a video clip of at least a portion of a bowling ball rolled down a lane, storing means for receiving the video signals and storing the video clip, an input terminal for receiving operator requests, a printer for printing a received video frame on paper, and a control circuit coupled to the storing means, to the printer, and to the input terminal for transferring a video frame of a stored video clip from the storing means to the printer for subsequent printing in response to an operator request.

Yet another aspect of the present invention is to provide a network of instant replay systems that may transfer video clips and video frames therebetween and to a video server connected to the network. To achieve these and other aspects and advantages, the instant replay system network comprises a network communication line and a plurality of instant replay systems each associated with at least one of the bowling lanes. Each of the instant replay systems includes a network interface coupled to the network communication line for transferring signals from the instant replay system over the network communication line, a video camera for generating video signals representing a video clip of at least a portion of a bowling ball rolled down the associated bowling lane, a memory device coupled to the video camera for receiving the video signals therefrom and for storing the video clip, a display monitor for displaying the video clip, and a controller coupled to the memory device, to the display monitor, and to the network interface for transferring a video clip from the storing means to the display monitor for display on the display monitor.

These and other features, objects, and benefits of the invention will be recognized by those who practice the invention and by those skilled in the art, from reading the following specification and claims together with reference to the accompanying drawing figures.

BRIEF DESCRIPTION OF THE DRAWINGS

In the drawings:

FIGS. 9*a* and 9*b* are an electrical circuit diagram in block form of an instant replay board 200 used in the system illustrated in FIG. 7;

DETAILED DESCRIPTION OF THE PREFERRED EMBODIMENTS

In the description below, a general description of the scoring system is first provided followed by a general description of the instant replay system, which, in turn is followed by a detailed description of the instant replay board and a description of the instant replay system operation.

Scoring System

Figure 1:
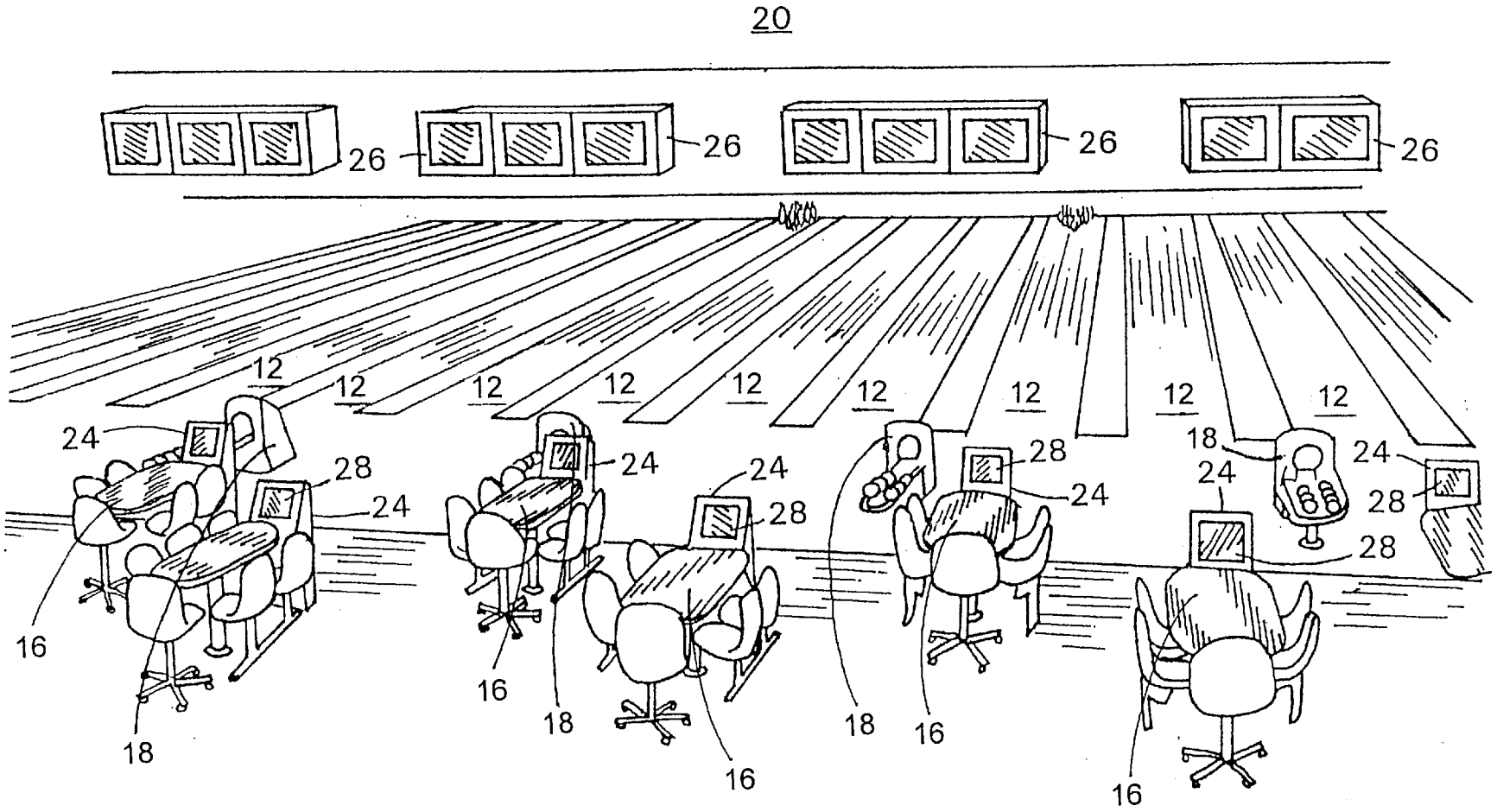
FIG. 1 is a perspective view of a bowling center including a bowling scoring system, according to the invention.
Figure 3A:
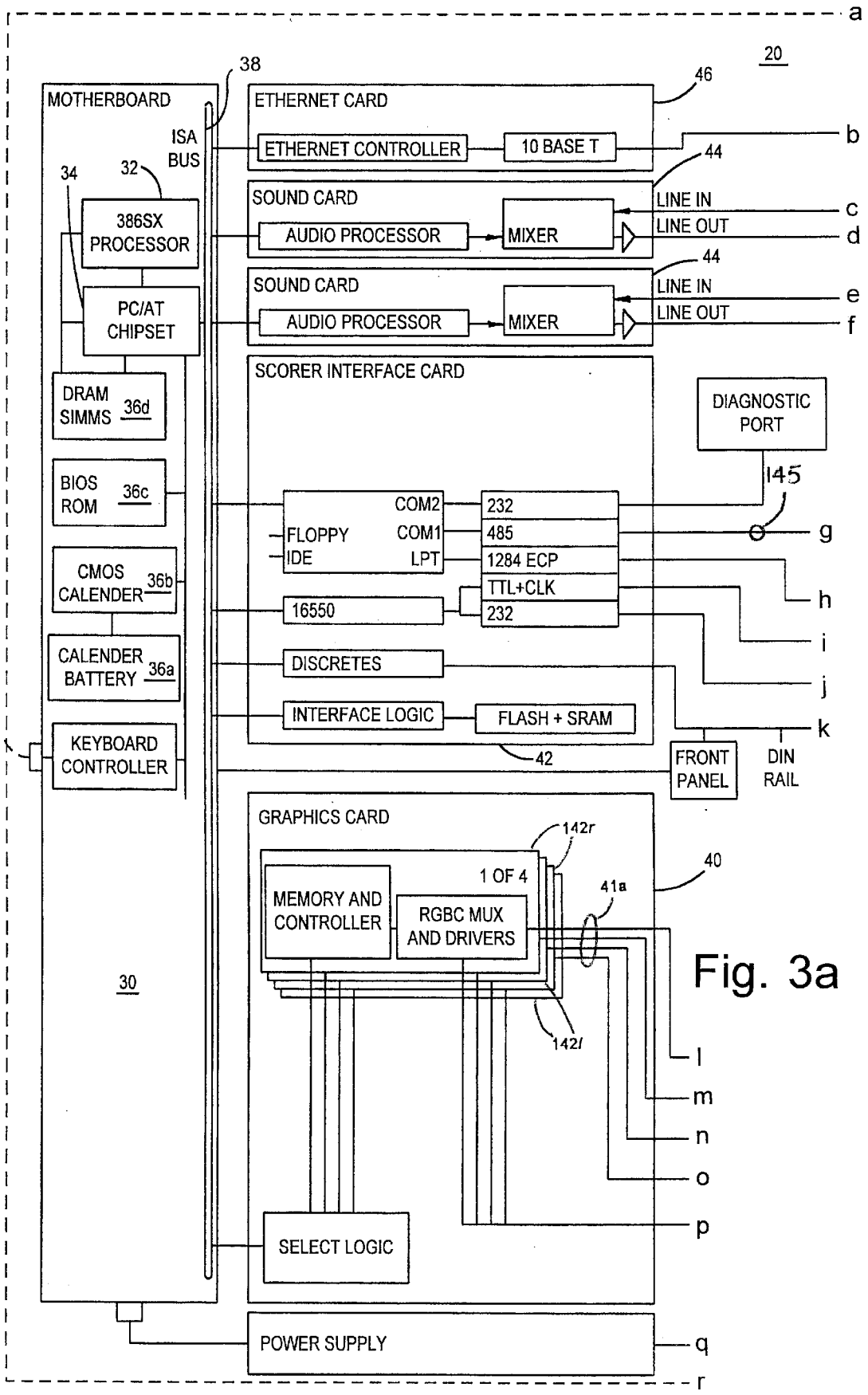
FIGS. 3*a* and 3*b* are an electronic block diagram of the bowling scoring system in FIG. 1.
Figure 3B:
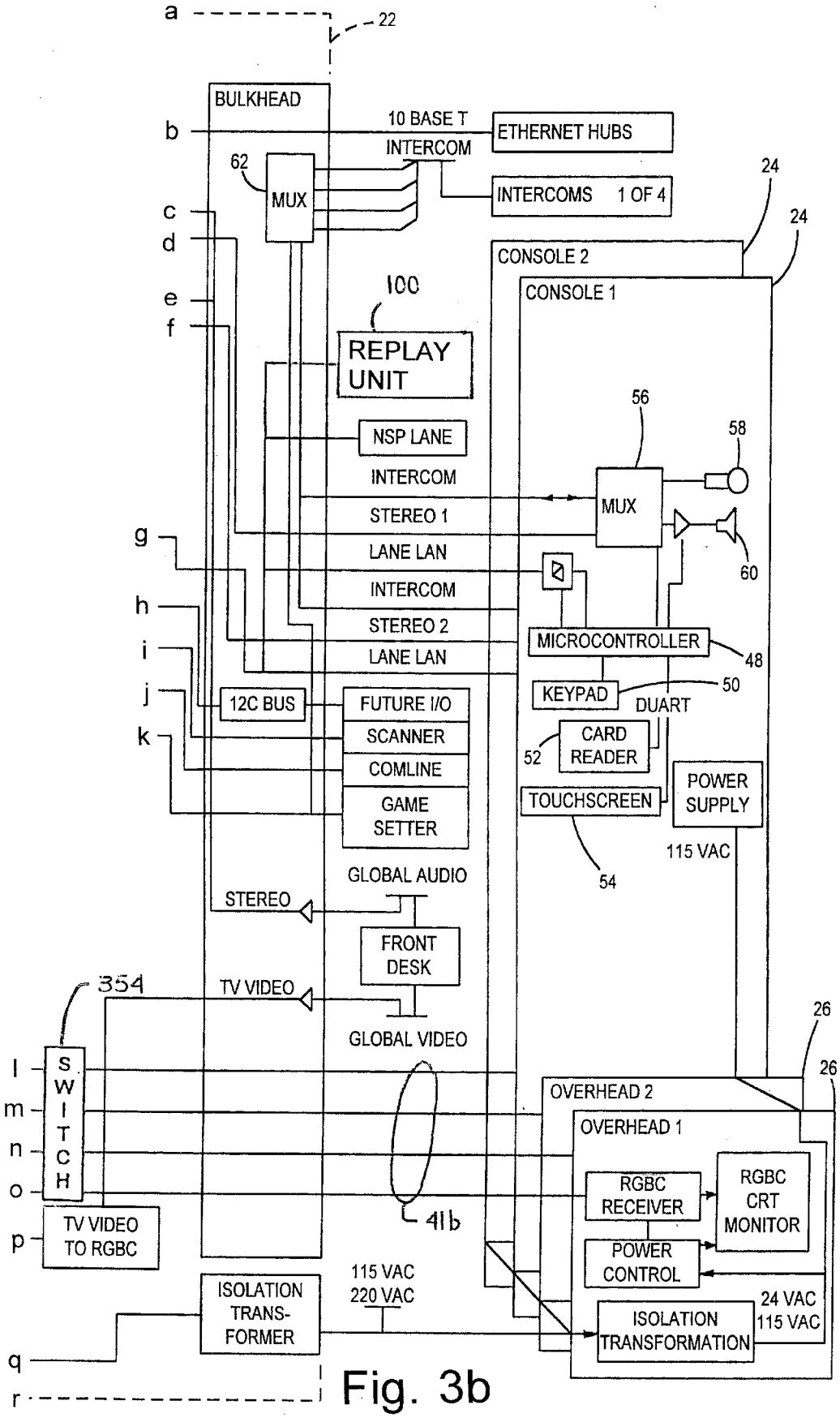

Referring now specifically to the drawings and the illustrative embodiments depicted therein, the bowling center illustrated in FIG. 1 includes an automatic scoring system 20 including a scoring processor 22 (FIGS. 3*a* and 3*b* ) and a plurality of scoring consoles 24. Automatic scoring system 20 may additionally include a plurality of overhead monitors 26 in order to display the same images displayed on displays 28 associated with each scoring console 24. However, the images displayed on overhead monitors 26 are not limited to those displayed on scoring consoles 24. For example, if overhead monitors 26 are grouped into three units for each pair of lanes, as illustrated in FIG. 1, then two of the three monitors may display the same graphic images as the scoring consoles 24 associated with the two lanes with the third monitor displaying other graphic images, such as a television program, video recordings, or the like.

Bowling scoring system 20 includes a pin-fall monitor (not shown) for sensing the pins knocked down at each lane 12 and one or more manager consoles (not shown) for providing overall control of bowling scoring system 20. Scoring system 20 further includes a plurality of bowling scoring consoles 24 which may be equal in number to the number of lanes 12 in the bowling center. The consoles and lanes are associated with one bowling scoring console 24 with each lane 12. A scoring processor 22, which receives input from bowling scoring console 24 and the pin-fall detection unit and computes the scores for each lane, may be positioned within bowling scoring console 24 or may be a separate assembly located in the vicinity of the pinsetter associated with each lane 12 or elsewhere in the bowling center.

As can be seen in FIG. 1, bowling scoring console 24 may be conveniently positioned adjacent a table 16 associated with an individual lane 12. However, the physical layout of bowling scoring system 20 is not limited to that illustrated in FIG. 1. For example, bowling scoring consoles 24 could be positioned adjacent a ball return 18, which is used in common with a pair of lanes.

Figure 2:
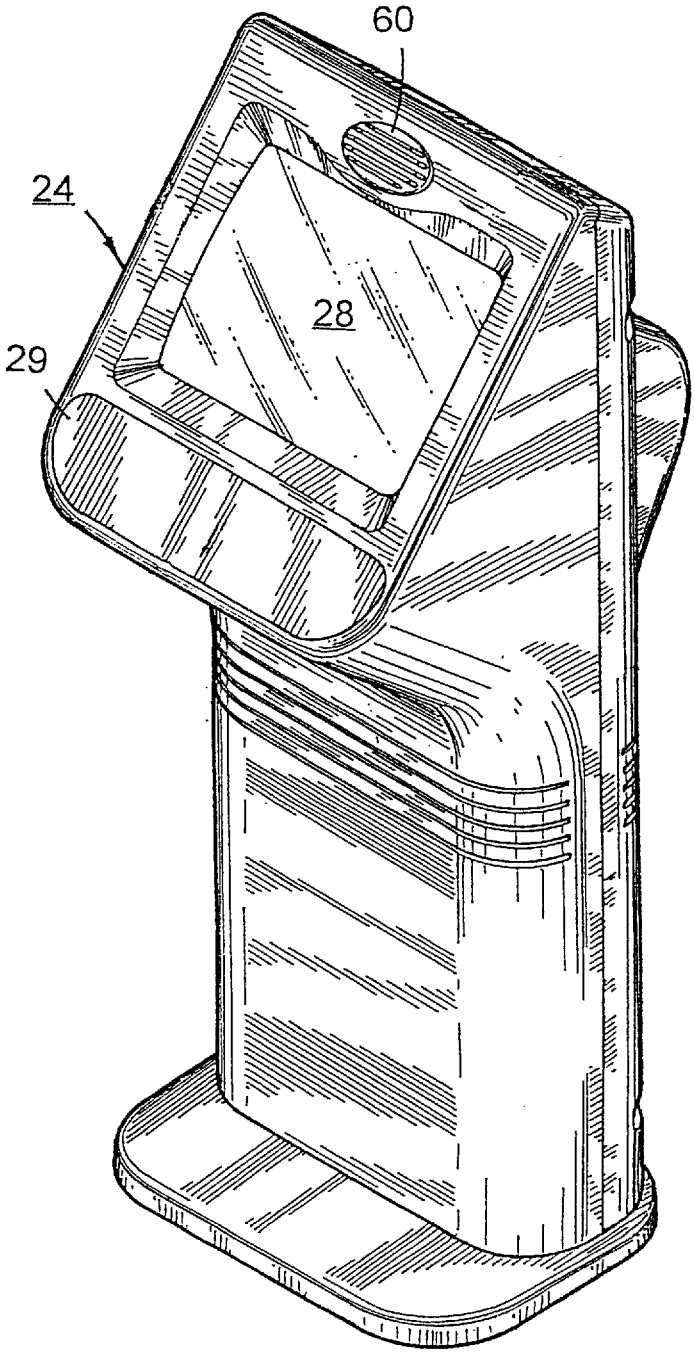
FIG. 2 is a perspective view taken generally from the front of a bowling scoring console, according to the invention.

In the embodiment illustrated in FIG. 2, bowling scoring console 24 is capable of displaying indicia on display surface 28 and for recognizing user touch of a particular portion of display surface 28. Such an input system, known as a "touch screen," eliminates the necessity for a separate mechanical keyboard input device. Alternatively, a mechanical keyboard may be positioned in an area 29 directly below display surface 28. Bowling scoring console 24 additionally includes a speaker 60 for providing audio information to the user. The detailed construction of display console 24 is disclosed in U.S. patent application Ser. No. 08/369,801, entitled "BOWLING SCORING CONSOLE," filed on Jan. 9, 1995, and in International Application No. PCT/US96/00049, filed Jan. 11, 1996, and entitled "BOWLING SCORING CONSOLE," the disclosures of which are incorporated herein by reference.

In the illustrated embodiment, automatic scoring system 20 utilizes an open architecture which allows assembly of the system substantially from off-the-shelf components, utilizing an ISA bus standard and an Ethernet communication network. In this manner, the scoring processor may be readily upgraded for enhanced microprocessor technology and the communication system is supported by industrial standard communication technology. Each scoring processor 22 includes a motherboard 30 having off-the-shelf components, such as a 486 processor 32, a PC/AT chip set 34, and other conventional components 36*a*–36*d*. A motherboard bus 38, which has a protocol according to ISA standards, supports a multiplexed graphics interface card 40 for supplying video signals to displays 28 for a pair of scoring consoles 24, as well as a pair of overhead monitors 26. Motherboard bus 38 additionally interfaces with a scorer interface card 42, which, in turn, provides interface with a pair of scoring consoles 24 for data other than graphic and audio data. A pair of sound cards 44 provide interface between ISA bus 38 and microphones 58 and speakers 60 in a pair of scoring consoles 24. An Ethernet card 46 interfaces ISA bus 38 with a 10 Base T hub utilizing standard Ethernet protocol. Each scoring console 24 includes a microcontroller 48 in order to receive inputs from a keypad 50 or a touch-screen 54 and to communicate with scoring processor 22. Microcontroller 48 additionally receives inputs from a card reader 52. A multiplexer 56 allows a microphone 58 and a speaker 60 to be utilized with either a stereo input channel received from a sound card 44 or from an intercom multiplexer 62.

Figure 4:
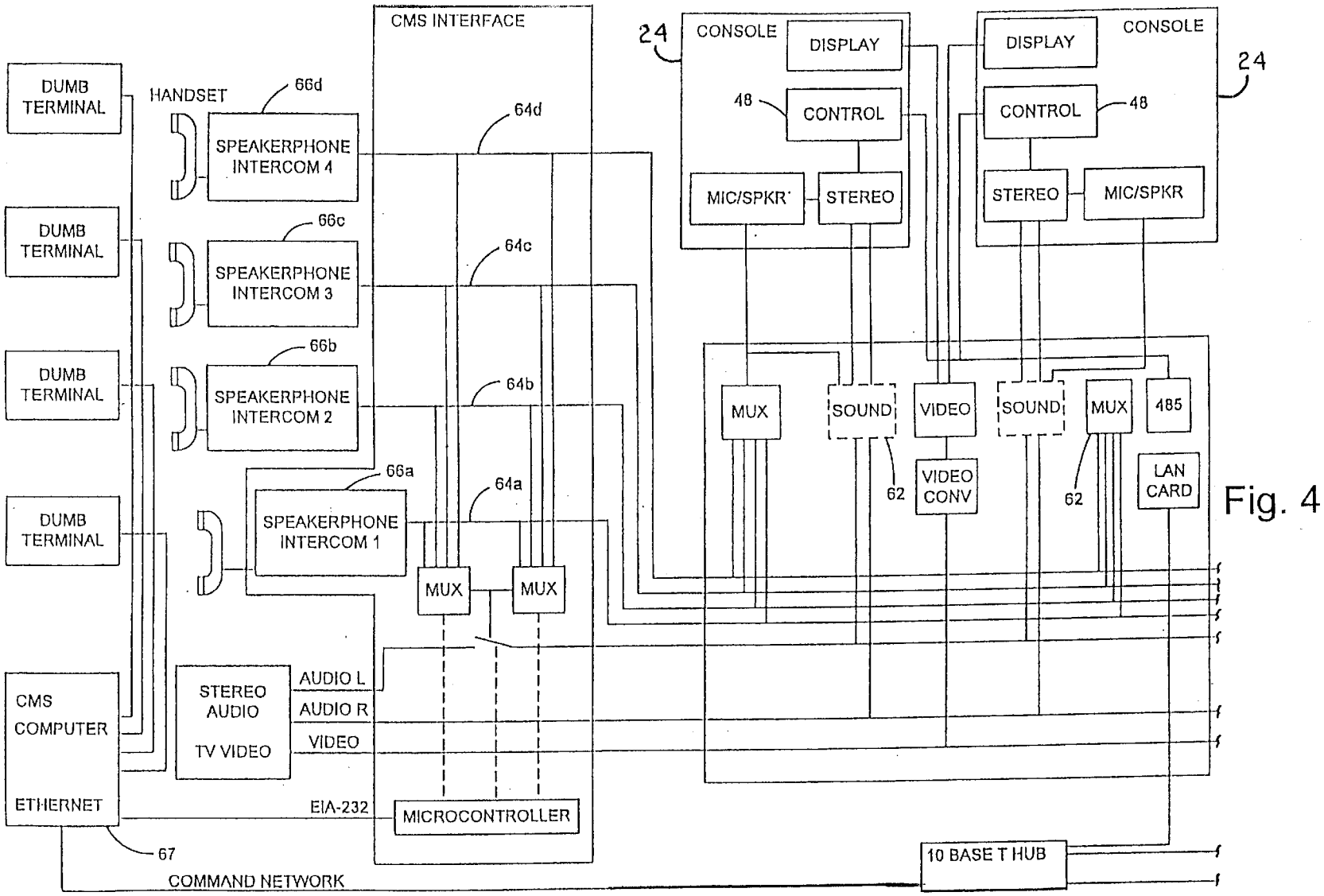
FIG. 4 is an electronic block diagram of an intercom system within the bowling scoring system.

Intercom multiplexer 62 multiplexes each microphone/speaker combination of each console 24 onto one of four intercom lines 64*a*–64*d* (FIG. 4). Each intercom line 64*a*–64*d* is connected to a speaker phone 66*a*–66*d* at a central control console 67. In this manner, a request for intercom connection at any console 24 may be intercepted by any speaker phone 66*a*–66*d*. This allows more than one intercom request to be serviced at a time, thus avoiding the necessity for stacking requests.

Figure 5:
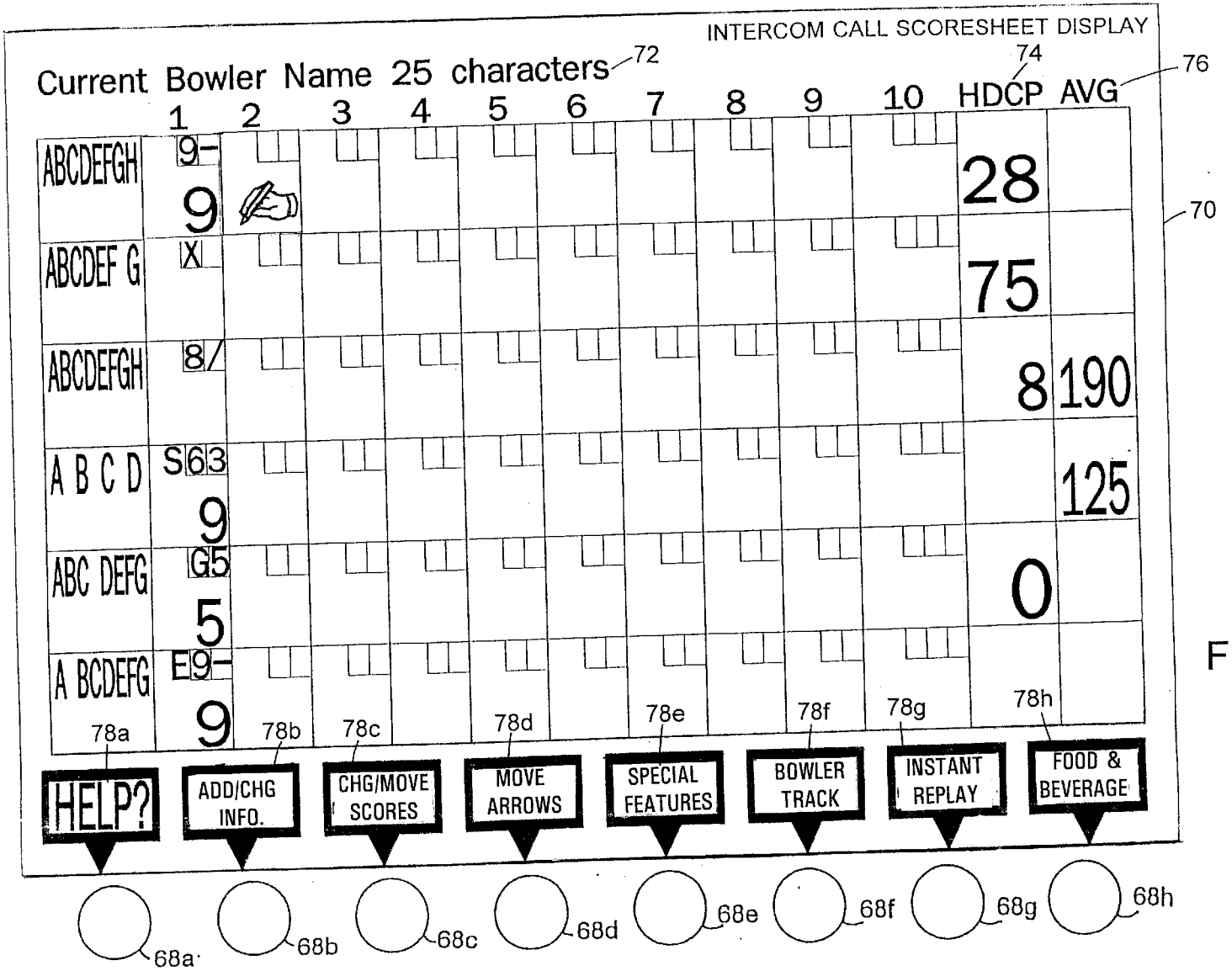
FIG. 5 is a soft-key user input device, according to the invention.
Figure 6:
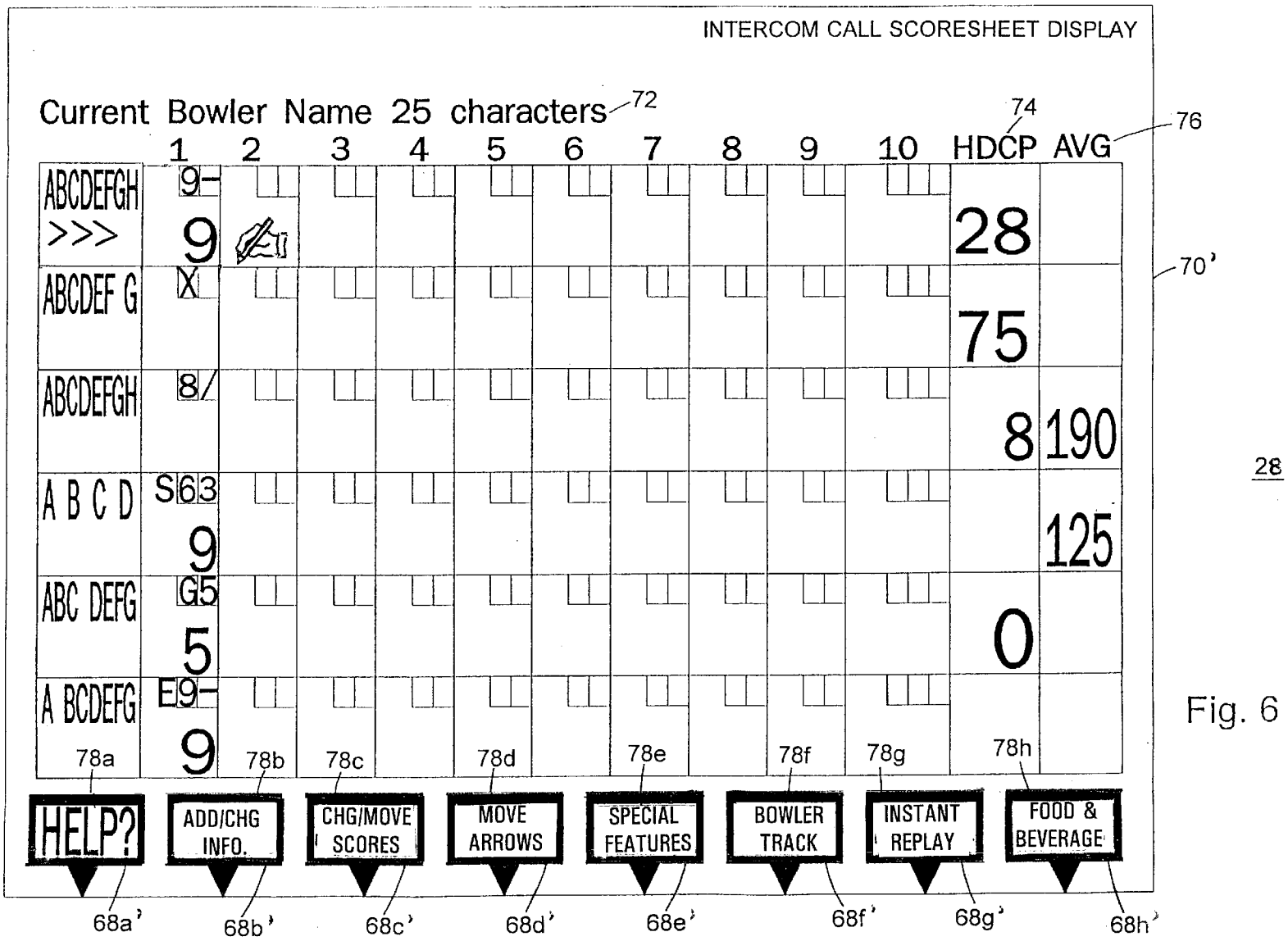
FIG. 6 is the same view as FIG. 5 of an alternative embodiment.

In one embodiment, scoring console 24 includes a plurality of unlabeled user input selection buttons or switches 68*a*–68*h*, which may be provided on a user input area 29 (FIG. 2) distributed along the bottom of a display surface 28 (FIG. 5). Display 28 is illustrated in FIG. 5 displaying a score sheet 70 for six bowlers including the name of the current bowler at 72, as well as the handicap 74 and average 76 of each bowler. Display surface 28 additionally includes a plurality of indicia areas 78*a*–78*h*, which are juxtaposed with the input keys 68*a*–68*h*. As stated above, in the embodiment illustrated in FIG. 5, input keys 68*a*–68*h* are mechanical key switches which are located on user input area 29 of scoring console 24 adjacent to display surface 28. In FIG. 6, a touch-screen display surface 28' includes a combination of user selection keys 68*a*'–68*h*' directly overlaying the associated indicia areas 78*a*–78*h*. Each key indicia area 78*a*–78*h* includes an indicia that prompts the user of the function performed by the corresponding selection key 68*a*–68*h*, 68*a*'–68*h*'. As will be set forth in more detail below, the indicia in each indicia area is established by the state of the software operating controller 48. Likewise, the function carried out by actuation of each of the selection keys changes dependent upon the state of the software of the microcontroller 48. This soft-key specification of the function of each key provides a unique input selection system.

Operation of the soft-key display is controlled by a soft-key routine. The details of the soft-key routine are disclosed in U.S. Pat. No. 5,618,238, filed on Jan. 9, 1995, and in corresponding International Application No. PCT/US96/00187 filed Jan. 11, 1996, and entitled "BOWLING SCORING SYSTEM," the disclosures of which are incorporated herein by reference. The soft-key system enables the program of microcontroller 48 to set and change the text label for each key 68*a*–68*h*, 68*a*'–68*h*' and its subsequent function at any time depending on the state of the program. The soft-key routine 80 matches the keyboard input with the soft-key map and performs the specific function when the key is actuated by the user. The soft-key is set up by displaying the soft-key label and enabling the specified function for the soft-key. During the execution of the software, a soft-key may change its meaning and subsequent action any number of times.

Instant Replay System Overview

Figure 7:
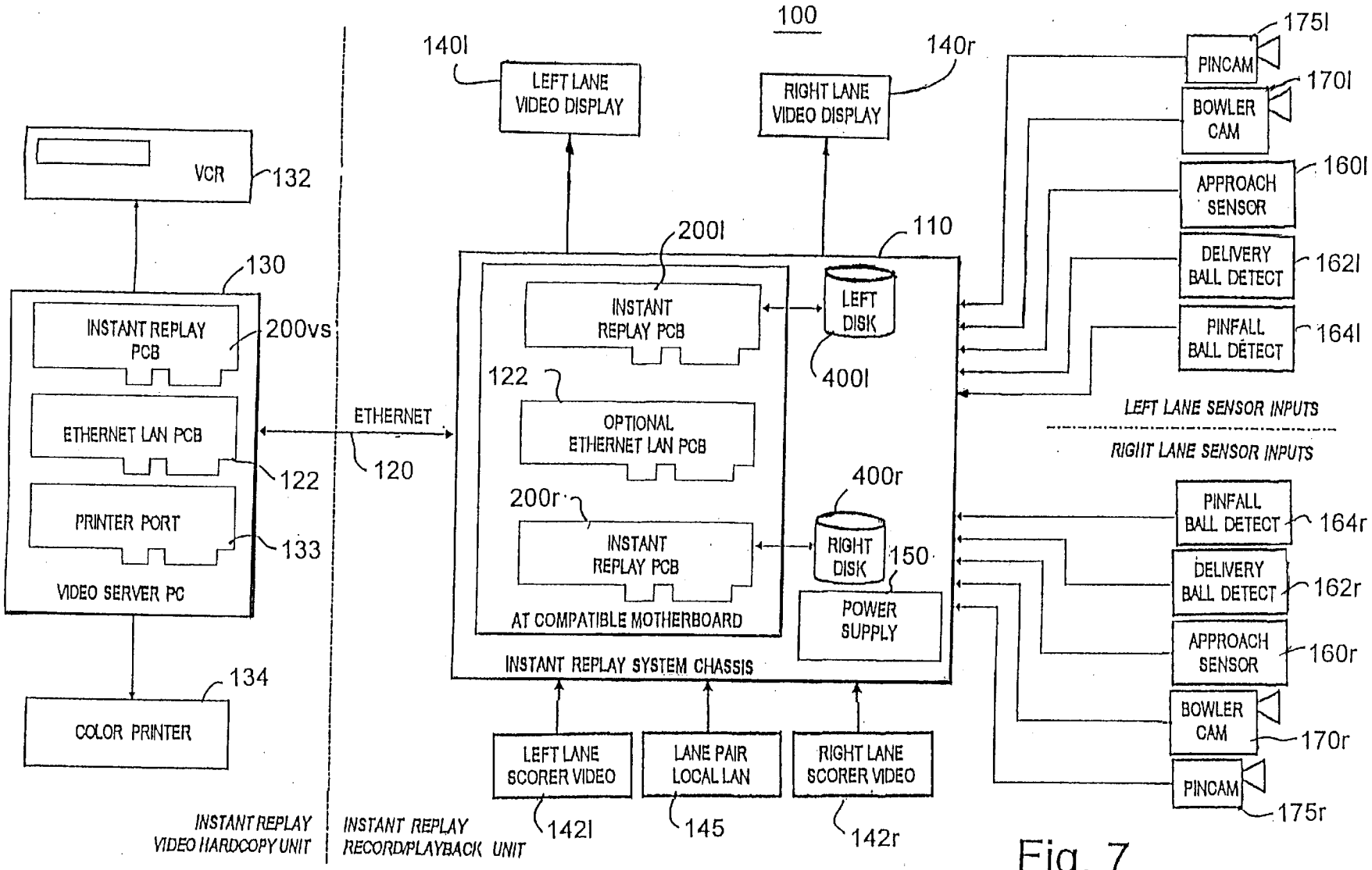
FIG. 7 is an electrical circuit diagram in block form of the instant replay system of the present invention.

Referring initially to FIG. 7, the instant replay system includes an instant replay record/playback unit 100. Preferably, the system is implemented with a plurality of such units 100 with one for each pair of lanes 12. Unit 100 includes an instant replay system chassis 115 for housing an instant replay processor 110 provided on an AT compatible motherboard, two instant replay boards 200*l* and 200*r* for the left and right lanes, respectively, of the lane pair that are plugged into the motherboard, hard disk drive sections 400*l* and 400*r* respectively coupled to instant replay boards 200*l* and 200*r*, and a power supply 150 for powering the unit. The detailed construction of instant replay boards 200*l* and 200*r* are described in detail below with respect to FIGS. 9*a* and 9*b*.

Figure 9A:
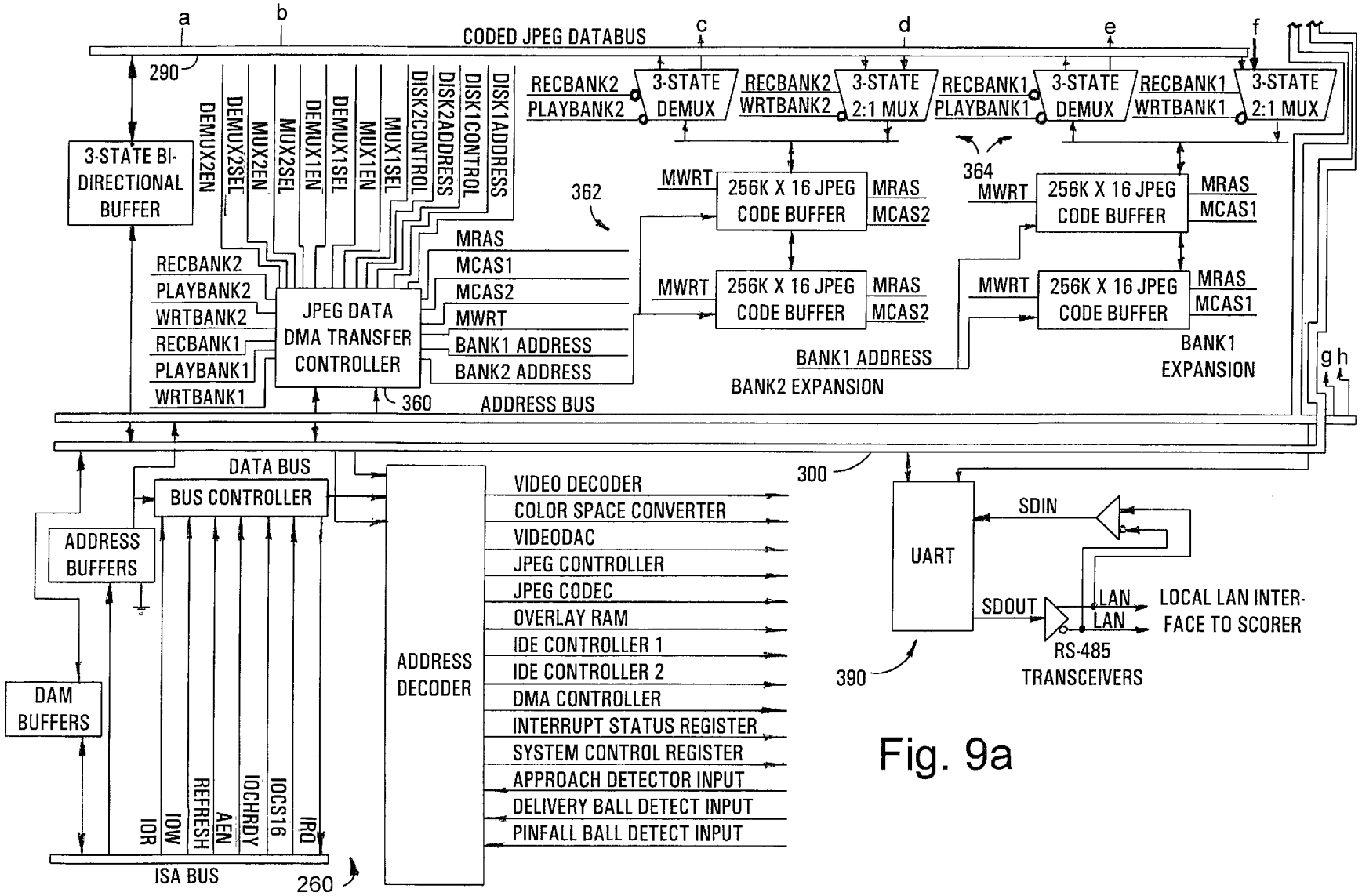

As described below, instant replay boards 200 are ISA bus compatible boards. The block diagram shown in FIGS. 9*a* and 9*b* represents a single instant replay board. Preferably, the boards are mounted in a replay box 101. As shown in FIG. 7, the instant replay boxes 101 are generally mounted on the wall down by the pinsetter and out of view with two cameras 170 and 175 each peeking out from under a masking unit 102 or the cameras may be mounted in front of the masking unit 102.

As part of the existing automatic bowling scoring system 20 provided for each lane pair, there is at least one display monitor 140*l* and 140*r* provided for the left and right lanes. These display monitors 140*l* and 140*r* may be scoring console monitors 28 and/or overhead display monitors 26. Unit 100 is connected between the display monitors 140*l* and 140*r* and the respective video feeds 41*a* from graphics cards 142*l* and 142*r* of the scoring system 20 in order to selectively switch the displayed video between the score sheet display 70 or other video normally generated by the scoring system 20 and the live and instant replay video provided by the instant replay unit 100. The detailed manner by which this switching is accomplished is described below.

As shown in FIGS. 3 and 7 unit 100 also is interconnected with scoring system 20 via a local LAN 145 that is provided for each lane pair. Preferably, the connection to local LAN 145 is through a RS485 connection. With this connection to local LAN 145, the instant replay unit 100 may receive playback commands from the scoring system 20 that are manually entered by the users into the bowling scoring system console 24. Further, the bowling scoring system 20 also provides information to unit 100 identifying the bowler, game number, frame number, the ball in the frame, for the bowler that is bowling or next to bowl. Other control information such as contrast, brightness, color, etc., may be provided to unit 100 from the scoring system console 24. Preferably, the instant replay system is used in connection with a bowling scoring system having an input section that has a software reconfigurable selection menu, such as one utilizing soft-keys or the like, so that all of the available commands of the instant replay system may be presented to the user for selection through the scoring console of the bowling scoring system. Thus, a separate terminal need not be provided.

As stated above, the bowling scoring system 20 is adapted for various display and console configurations. For example, the system 20 may be configured to have overhead display monitors 26 and scoring consoles 24 with no console displays, overhead monitors 26 and scoring consoles 24 with a console display 28, or with no overhead display monitors and scoring consoles 24 with a console display 28. The soft-keys that the bowler would press in order to control instant replay, are preferably displayed on a lower console display while the overhead display is used for instant replay. With such a configuration, actual control information is not displayed on the overhead monitor 26 and during an instant replay when video is being shown, all other score originated imagery is switched off. So in the configuration where there is a lower and upper display, the upper display 26 would be showing instant replay while the lower display 28 would be showing the soft-keys that a bowler could use to control the playback, the direction of the playback, the speed of the playback, etc.

As stated above, in some bowling scoring system configurations there may be overhead displays 26 but no lower displays 28 on the scoring console 24. In such a configuration where there is no lower display 28 to show the control imagery soft-keys that are used to control instant replay, the instant replay unit 100 may provide a bitmap overlay RAM 370 (FIG. 9*b*) for superimposing those control keys on the instant replay video or on the live video displayed on overhead display 28. This is accomplished through the provision of an overlay frame in the video digital/analog converter, a bitmap memory, and some control circuitry provided on the instant replay boards 200 that allow superimposing the scorer generated imagery on the actual instant replay video image. The overlaying of the soft-key imagery is also desirable in a scoring configuration where there are no overhead displays 26 and the only display monitor 28 is on the scoring console 24.

As explained above, each instant replay unit 100 preferably includes a computer processor 110. An optional Ethernet card 122 may be mounted on the motherboard for connecting processor 110 to an Ethernet LAN 120. Also connected to Ethernet LAN 120 is a video server 130, which is coupled to at least one VCR 132 and a color printer 134. Video server 130 may be located at the front desk or any other location in the bowling center. By providing a video server 130 and connected VCR 132 on a LAN in this manner, recorded video segments sent thereto from the various replay units 100 may be transferred to video tapes. Thus, if a bowler were to roll their first strike, pick up a difficult split, bowl a perfect game, etc., the bowler can request that the recorded video be transferred to a VCR tape. Because the video data transferred from the hardware configurations 100 over LAN 120 to the video server 130 is compressed digital video data, video server 130 preferably includes an instant replay board 200vs similar in construction to boards 200*l* and 200*r*. As explained below, instant replay boards include a CODEC, such as a JPEG CODEC described below, a color space converter for converting the decompressed YUV digital video output from the CODEC into RGB digital video, and a video digital/analog converter for converting the video to a suitable analog format for recording on a VCR tape.

As described below, the compressed digital video data sent over LAN 120 to the video server 130, may not be delivered in real time. Therefore, the video server also preferably includes a buffering mechanism, such as a hard disk drive, for storing the blocks of video data sent over LAN 120 so that, after all of the blocks of video data are received and stored, the video data may be read out of the hard disk in real time.

The instant replay system also preferably includes at least one color printer 134 coupled to video server 130. By providing a color printer 134 on the LAN 120, video still frames of the recorded video may be transferred from the replay units 100 at the lane pairs over the LAN 120 to be printed out on the color printer 134. Preferably, printer 134 is a high quality color printer, such as an Epson digital color printer.

It will be apparent to those skilled in the art, that other hardware may be connected to LAN 120 to perform various functions. For example, a color scanner may be connected so that a color image may be digitized and transferred to a particular lane for display on the display monitors associated with that lane. Further, a video clip recorded on a VCR tape could be read from VCR 132, digitized, and transferred to one of the hardware configurations associated with a lane for display on its monitors.

Preferably, there are between one and four hard disk drives 400 per lane. With two IDE interfaces on each board 200 and two hard drives per interface there would be four hard disk drives per lane. The number of hard drives per lane may vary depending on the amount of storage the bowling center wants per lane. With four disk drives per instant replay board 200, an instant replay box would have eight hard disk drives. Those disk drives then are local to that particular lane pair and there is a 1:1 mapping between a lane and an instant replay board. The disk drives that are attached to a board are not used globally across multiple lanes, but are assigned to one single lane.

In selecting a suitable hard disk drive, it was determined that seek time is not particularly important because the system is not really running in an edit mode. The most important parameter in selecting a hard disk drive is the sustained media transfer rate, which is the transfer rate in Megabits per second between the disk drive head and the recording medium, which is the platter on the disk drive. This transfer rate is preferably 25 Megabits per second or faster. The hard disk drives used in the invention preferably have the ability to sustain a minimum media transfer rate of 30 Megabits per second. Disk drives that are only able to burst that rate are less desirable because, when the data rate drops below the required minimum, visually objectionable artifacts appear, such as jerky video.

After that, the next most important characteristic is how the hard disk actually caches its data and how it manages its cache. One factor that disqualifies a lot of the disk drives is the inability of the disk drives to intelligently cache data because, in JPEG, the size of the compressed picture is a function of this image's content, particularly, the high frequency content of the picture. Images with lots of high frequency content will code to a larger frame than images with less high frequency content. If an image consists primarily of flat tones, smooth continuous colors, etc., that image will code to a relatively smaller size. As a result, as video data is being recorded on the hard disk, the coded size of frames will vary from frame to frame. Consequently, the disk drive should have a very robust caching scheme whereby the disk drive is able to accommodate the fluctuating frame size.

Further, the hard drives preferably have at least a 1 GB capacity. The greater the size of the disk drive, the greater the recording durations may be or the greater the number of recorded games may be. Two disk drives that meet all of the above preferred criteria are a fireball 1080AT and a fireball 1280AT model disk drive manufactured by Quantum.

Although a plurality of IDE hard drives are described with a 1:1 or 4:1 lane ratio, different drives and different drive configurations may be used. For example, the system could be implemented with SCSI drives or perhaps one large drive per lane pair provided the drive is capable of sustaining a suitable transfer rate.

Figure 8:
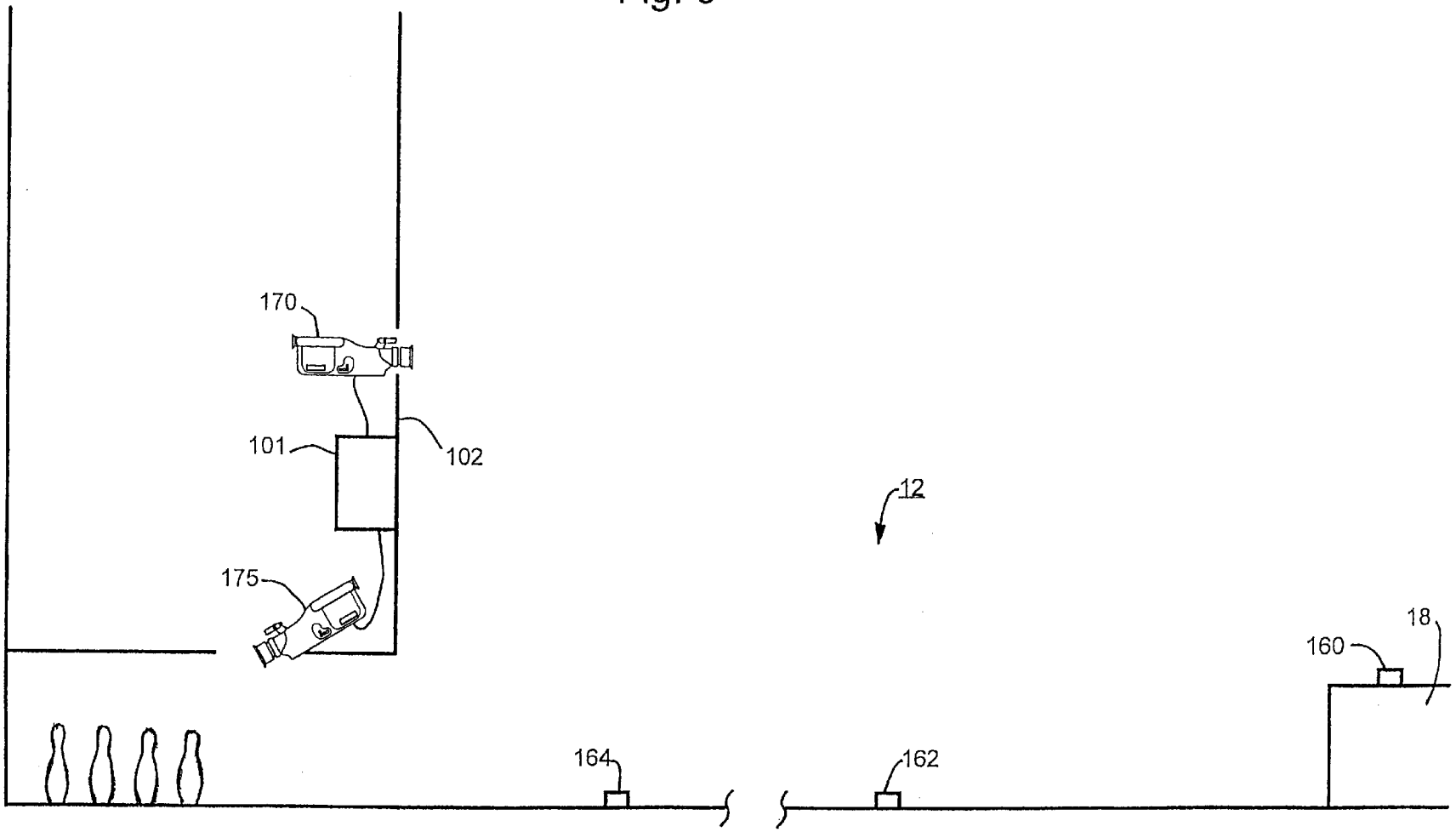
FIG. 8 is a perspective side view of a bowling lane in which the instant replay system of the present invention may be implemented.

As shown in FIG. 8, at the approach area of each lane of the lane pair, there is provided an approach sensor 160 for detecting the presence of a bowler in the approach area. Approach area sensor 160 may be any suitable conventional motion detector. When a bowler is detected, sensor 160 supplies a signal to processor 110 through an associated one of boards 200 causing processor 110 to select the video feed from an approach area camera 170 that is focussed and mounted relative to lane 12 to record video of the bowler in the approach area.

Along each of the lanes 12, there is provided a first ball detector 162 for detecting the delivery of the ball, and a second ball detector 164 located further down the lane for detecting when the ball is within the view of a pin area camera 175. As described below, the outputs of the sensors and detectors are input into the associated board 200 for that lane 12. Pin area camera 175 is focused and mounted relative to lane 12 to record action in a pin-fall area at the end of lane 12.

The instant replay system processor 110 determines when to start recording upon detection of an external event of a bowler stepping up to the approach area. This is done by sensing when the bowler breaks an invisible infrared beam of approach sensor 160 located some place in the proximity of where the bowler would pick up the ball. At that point, processor 110 instructs board 200 to begin recording into a circular buffer on one of the hard disks 400 associated with the lane where the bowler was detected. When the circular buffer (i.e., a first-in-first-out (FIFO) buffer) is filled with compressed digital video data, it dumps the first-in data while continuing to store the incoming video data. Preferably, the circular buffer stores approximately five to ten seconds of video. The circular buffer is continuously written to until it is determined that the ball has been rolled and is at a predetermined location down the lane as detected by the first ball detector 162. In this manner, only the five to ten seconds of the bowler's approach just prior to ball delivery is recorded and disk space may be preserved by not storing video of any extended length that may occur prior to the bowler beginning an approach.

When the bowler rolls the ball, the system detects the presence of the ball in the lane at a first location using the first ball detecting sensor 162. When the system detects the presence of the ball using the first ball detecting sensor 162, processor 110 instructs board 200 to stop recording the bowler in the approach area using the approach area camera 170 and switches the displayed video to video black.

Preferably, the system utilizes the second ball detecting sensor 164, which is positioned further down the lane to display pin video and to trigger the recording of the video delivered from the pin area camera 175. Thus, as the ball rolls further down the lane, the second ball detector 164 picks up the presence of the ball and signals board 200 to start recording the video from the pin area camera 175. In this manner, during the time the ball is rolling down the lane, that period of time in which the ball is between the first and second ball detectors is not recorded to conserve space on the disk drives. In terms of training, the period that the ball is rolling down the alley is relatively unimportant for someone analyzing their delivery and the subsequent results. As will be appreciated by those skilled in the art, if disk space is not a concern, then the system could be readily modified to record the entire event.

As explained in greater detail below, the system preferably utilizes time-outs that determine the actual duration of a recording period for both the delivery and the pin-fall and for how long after the pin-fall has occurred that the system commences automatic playback. Unlike any prior systems, these time-out parameters are preferably controlled by software so they can be set by the user right at the scoring console input terminal or by the bowling center itself. Thus, the system is very flexible and may be easily adjusted by non-skilled individuals.

Instant Replay Board 200

Having provided a general description of the instant replay on a system level, a detailed description of instant replay board 200 is described below with reference to FIGS. 9*a* and 9*b*. Basically, instant replay board 200 represents a single ISA PC board that goes into an IBM PC or compatible PC. The board 200 consists of a video section 210 that takes video in from a standard video camera and decodes that video into digital format. That digital video then goes to the next block of logic which would be a JPEG CODEC, which is a coder/decoder and is the compression section 220 of the board. Then, from the compression section 220, the digital compressed data goes to a computer hard disk drive section 400, which is connected locally onto the board via IDE interfaces 410 and 412. These three sections essentially represent the data path for recording the video obtained from cameras 170 and 175. The data path for playback is essentially the opposite in that the compressed digital data is read from the disk drive section 400 to the CODEC 220 and out from the CODEC 220 into a digital/analog converter section 240 where the picture is converted in its analog form for display on monitor 140. The board 200 further includes a couple of additional sections or elements to the board. One of these sections is a video display section 250 for taking the live scene from the digital video and reconverting it into analog to show the analog video on the scorer display 140. Another additional section of the board 200 is a bus interface section 260, which is preferably a custom interface to standard ISA Bus that is common to virtually all PCs.

The board 200 is capable of instant replay operation in large part due to the separation of the compressed data video bus from the computer data bus. By separating and coupling those two data paths, any bandwidth constraints that the computer's data bus would impose are eliminated. Preferably, there are four data busses on board 200 including a YUV digital video bus 270, a JPEG data bus 280 for the disk drive, a JPEG data bus 290 for the CODEC, which is separate from JPEG data bus 280, and the computer's data bus 300 for the general purpose of the host processor 110 and the different elements of board 200.

The atomic unit of recording is typically a video field. Such fields are displayed sequentially at a rate of 60 fields per second. Two fields make a frame, so the frame rate is normally 30 frames per second. Although the system of the present invention is described as using this format, other display formats may be used.

Having generally described board 200, the details of board 200 are described below first with reference to a record operation. When board 200 is used to record video, the analog video signals from the pin area camera 175 and the delivery area camera 170 are sequentially applied via input lines 310 and 315, respectively, to a video A/D converter and decoder 320 that takes the selected composite video waveform from one of the cameras and converts the video signal into a digital signal and that digital signal is demodulated into the component luminance and chrominance parts of the video signal. The video signal is made up of colors and brightness and they are treated separately in the digital world. The format of the output digital video signal is 4:2:2 digital video that conforms to the CCIR 601 square pixel standard.

As the digital video comes out of decoder 320, it goes into a JPEG CODEC section 220, which may be implemented using an off-the-shelf component that receives the raster-formatted YUV video from decoder 320, converts it into an 8 by 8 pixel block, takes that 8 by 8 block and transforms the video from the time domain into the frequency domain via a discrete cosine transform, and then entropy codes the resultant frequency coefficients to produce a compressed data string. Preferably, the data is compressed at a rate of about 10:1, although other compression ratios may be used. JPEG stands for joint photographic experts group and is an ISO standard that defines the syntax of the data as it is formatted.

JPEG CODEC 220 may be any commercially available chip set that is capable of performing the functions described herein. In general, JPEG CODEC 220 includes a JPEG controller 330 that is coupled to YUV digital video bus 270, to CODEC JPEG data bus 290 and to the other components of JPEG CODEC 220. JPEG CODEC 220 further includes a JPEG CODEC circuit 332, which is coupled to JPEG controller 330 and to computer data bus 300, a code buffer 334, which is coupled between JPEG controller 330 and JPEG CODEC circuit 332, an 8 bit latch 336, which is coupled between JPEG controller 330 and JPEG CODEC circuit 332 and coupled to CODEC JPEG data bus 290, and a raster-to-block strip buffer 340 having a first SRAM chip 342 and a second SRAM chip 344 each coupled to JPEG controller 330.

Although JPEG is described as the preferred compression technique, other forms of discrete cosine transforms (DCT) may be used for compression of the digitized video signal. Specifically, like JPEG, DCTs combined with some sort of entropy or Huffman coding, and possibly using a temporal compression scheme such as MPEG (motion picture experts group) are particularly well-suited for compressing the video captured using the instant replay system of the present invention.

At the same time that the digital video is being compressed, it may also be displayed on monitor 140. To accomplish this, the YUV data supplied from decoder 320 onto YUV digital video bus 270 is received by a color space converter 350 and is color space converted into red, green, and blue (RGB) video components. These RGB color video components are supplied to a video digital/analog converter 352 that converts the digital video back into analog at which point it is displayed in a format in differential red, green, and blue on display 140 by selecting the live digital video through a RGB video multiplexer (MUX). The differentiation operation is performed by the three differential drivers 356 supplied for each of the RGB color components.

As the compressed data comes out of the CODEC section 220, a controller 360 referred to as JPEG data DMA transfer controller, transfers the compressed data directly onto one of the IDE hard disk drives 400, which is connected to the instant replay board 200. Which hard drive the compressed data goes to is controlled by processor 110 through software. The transfer of the compressed data from CODEC section 220 to hard drive section 400 is carried out using a plurality of buffers 362, and multiplexers and demultiplexers 364 coupled between CODEC JPEG data bus 290 and disk JPEG data bus 280. The operation of the buffers, multiplexers, and demultiplexers are controlled by JPEG data DMA transfer controller 360. Thus, the compressed digital video is not passed through the computer's data bus 300 during the recording operation.

In terms of playback, the video data signal path is essentially the opposite of that described above for recording. As described in detail below, playback may be set to automatically occur when recording is finished or it may occur in response to the request of the user through manipulation of the input portion of the scoring console. During playback, the video data is read from the hard disk 400 at the instruction of DMA controller 360 and transferred from the hard disk section 400 to the JPEG CODEC 220. The direction of the JPEG CODEC chip 220 is turned around for decompressing as opposed to compressing video data in response to a command from processor 110. Thus, the compressed digital video comes off the disk drive 400 onto disk JPEG data bus 280 and goes over the CODEC JPEG data bus 290 into the JPEG CODEC chip 220 where the 8 by 8 pixel block-oriented data is transformed via an inverse DCT back into a raster format in digital YUV, which is exactly the same format as what comes out of the video decoder 320. The YUV data coming out of the JPEG chip set goes over the YUV digital video bus whereupon it is converted into RGB by color space converter 350, converted back from digital to analog video data by video digital/analog converter 352, and displayed in differential format on display 40.

As described above, instant replay board 200 includes an ISA bus interface. It is through the ISA bus that the instant replay software in the processor 110 is able to communicate to the hardware on board 200 what the hardware is to do, e.g., whether it is to operate in the record mode or playback mode. The instant replay system allows control through the ISA bus of the parameters of the playback and the nature of the playback. For example, the instant replay software of processor 110 can tell the system to playback at 30 frames per second or 15 frames per second or 7 frames per second or whatever frame rate is desired. The system further allows control of the timing parameters defining how long a recording is to last. The software gets its commands from the scoring system through a connection 390, which is preferably a RS485 connection to local LAN 145. There is one local LAN connection per lane pair.

Board 200 also includes a plurality of multiplexers 415 that allow the hard disk drive to be multiplexed between the computer's data bus 300 and disk JPEG data bus 280 of the instant replay board 200. By providing multiplexers 415, the system may boot from a DOS partition on the hard drive 400. Further, by providing multiplexers 415 in combination with two IDE interfaces 410 and 412, the system processor 110 can be accessing data on one hard disk while the instant replay system is writing to another hard disk. This is desirable because one of the instant replay configurations allows for a bowler to select some section of video data, and requests that that video imagery be sent to the video server 30 behind the center management desk where it can be decompressed and re-encoded and sent to a video tape so that the bowler can take it home and watch it on a VCR. This capability is facilitated by providing simultaneous access to the disk drives by the instant replay DMA hardware and the processor 110.

As stated above, the data bus 300 is the data bus for the system processor 110. In this way, processor 110 may communicate with any system component that is connected to data bus 300. The YUV digital video bus 270 is used exclusively between video decoder 320, color space converter 350, and JPEG CODEC 220. As explained above, there are two JPEG data busses, one of them is called the CODEC JPEG data bus 290 and the other one is called the disk JPEG data bus 280. Multiplexers 364 connect these busses together so depending on whether the system is in a record or a playback mode determines the path of that data going to and from the disk drives 400 and to and from the CODEC 220. Multiplexers 415 allow processor 110 to read or write data from the disk drive. In such a case, muxes 415 would be configured in such a way that the data coming off of the disk drive would go through the muxes onto data bus 300 and then out to the processor 110 or out of the disk drive onto the disk JPEG data bus 280 through muxes 364 and back onto the CODEC JPEG data bus 290, which is local to board 200.

Because the data path between the disk drive 400 and the CODEC 220 should be real time, the flow of data therebetween should not be interrupted. However, if a bowler bowls a 300 game and wants to make a video tape of that game, the board 200 transfers the video clips for that game over data bus 300 through processor 110 up to the video server 130 over the Ethernet LAN 120. The transfer of the video of the game to be transferred to tape does not, however, need to be sent to the server in real time. Rather, that transfer could be an interrupted process. Once the game video is on the video server 130, a board similar to board 200 at the server, is used to decompress, playback, and encode the video into a format that is compatible with a VCR 132. Consequently, server 130 has to be able to stream the video off the hard disk 400 out of the encoder so that it can be recorded in real time even thought the actual transfer of data between the instant replay board 200 and the video server 130 does not have to take place in real time. Thus, compressed data transfers between processor 110 and server 130 are lower priority than compressed data transfers between disk 400 and CODEC 220. For example, processor 110 initiates a data transfer between CODEC 220 and disk 400 utilizing DMA controller 360, which effects that transfer in real time independent of the processor 110. At the time processor 110 instructs DMA controller 360 to begin recording, processor 110 also configures the hard disk for DMA transfers. Once the DMA controller 360 begins recording, it sends an acknowledgement back to processor 110. Upon receiving the acknowledgement, processor 110 is free to resume transmission of the lower priority video data over the Ethernet and onto the video tape. Thus, it can be seen that the process of recording video and transferring data over the Ethernet are really separate and distinct processes that are running in parallel. That is why multiplexers 415 and 364 split the JPEG data bus and the CPU data bus, so data can be transferred simultaneously through both of them and is why the system preferably includes two IDE interfaces 410 and 412 per board 200.

By establishing such independent and separate data channels, and this priority scheme, if a bowler were to request that a 300 game be recorded from disk drive to tape, the system will not make the bowler and all other bowlers on that lane wait to continue bowling until that 300 game gets transferred. Further, by flipping over to a hard disk connected to one IDE interface 410 to record new video while transferring video data of a 300 game from a hard disk connected through the other IDE interface 412, games do not have to be delayed while data is transferred to tape.

Because the bowling scoring system knows who is bowling each ball in each lane, it is responsible for informing the instant replay system who is bowling so that the appropriate information may be tagged to the video and stored with the video on the hard disk. Alternatively, a table may be maintained for mapping the bowler's identification, frame number, the ball in the frame, and game number with a stored unique identification code of the video clip. By tagging the recorded video clips with, or otherwise tracking, the bowler, the frame, the ball in the frame, and the game number, that information can be pulled off the disk drive or read from the table to determine who each particular video belongs to and where in the sequence of the bowling games to which the video corresponds. So every record of video is preferably tagged with that data. There are two processors and two processes running here. There is the scoring system processor that knows which bowler is bowling and also knows what action the bowler is taking in terms of pressing the input keys on the scoring console. Any such information is conveyed over the local LAN 145, which is not Ethernet, but RS485 and that local LAN 145 is local to a particular lane pair. This information is conveyed over the local LAN 145 to the processor 110, which is dedicated to instant replay. Again, instant replay hardware is plugged into a standard IBM PC motherboard, so the instant replay software executable is actually running under standard DOS of the PC. Thus, when that information is conveyed over the local LAN 145, the processor 110 that is dedicated to instant replay picks up that information. The instant replay executable resident on processor 110 then interprets what action has been taken and sends commands to the instant replay hardware on board 200 that effects that action. So, for example, if bowler number 3 wanted to look at game 1, frame 3, ball 2, then that information is conveyed to the instant replay executable from the bowling scoring system processor and that executable would be responsible for locating that record on the hard drive and then informing the instant replay DMA controller 360 to move the necessary amount of data from the designated drive address to one of the display monitors 140 in a playback mode.

There is one instant replay executable per lane pair, so processor 110 knows what is on the instant replay board 200 and disk 400 associated with the right lane and what is on the instant replay board 200 and disk 400 associated with the left lane. Thus, it does not matter which lane any particular bowler is bowling on because if that bowler requests the system to display a particular ball in a particular frame, the processor 110 for that lane pair will know on which lane the particular ball was rolled and retrieve the video from the disk drives associated with that lane and will instruct that associated board to playback the requested video on the display monitor associated with that lane.

JPEG data DMA transfer controller 360 is functionally spread over a few IC chips, which may be standard off-the-shelf programmable logic array (PLA) components that are programmed with codes to make them operate in a specific functional manner. Essentially, DMA controller 360 functions to effect data transfers between the hard disk and the JPEG CODEC independently of the instant replay host processor 110 and on a path that is separate from the host processor's data bus 300. The instant replay executable causes the host processor 110 to issue commands to the disk drives to operate in a DMA mode as opposed to a programmed I/O mode and passes a block count to the disk drive to determine how much data is transferred and it also provides the drives a starting address from which the data is to be transferred. Then processor 110 instructs DMA controller 360 to commence the transferring of data. DMA controller 360 emulates the interface to the IDE disk drive, which is an ANSI standard for IDE interfaces, on one side, and on the other side, DMA controller 360 emulates the ISA bus itself. Further, DMA controller 360 decouples the JPEG CODEC 220 from the host data bus 300, in terms of the address and data and control bus. In this manner, the DMA controller 360 effectively sits between the disk drive and the JPEG CODEC although no data actually passes through the DMA transfer controller 360. DMA controller 360 controls the IDE bus and controls the host interface on the JPEG chip, and by controlling those two interfaces in the properly timed manner, DMA controls the transfer of data from one device to another.

System Operation

Figure 10:
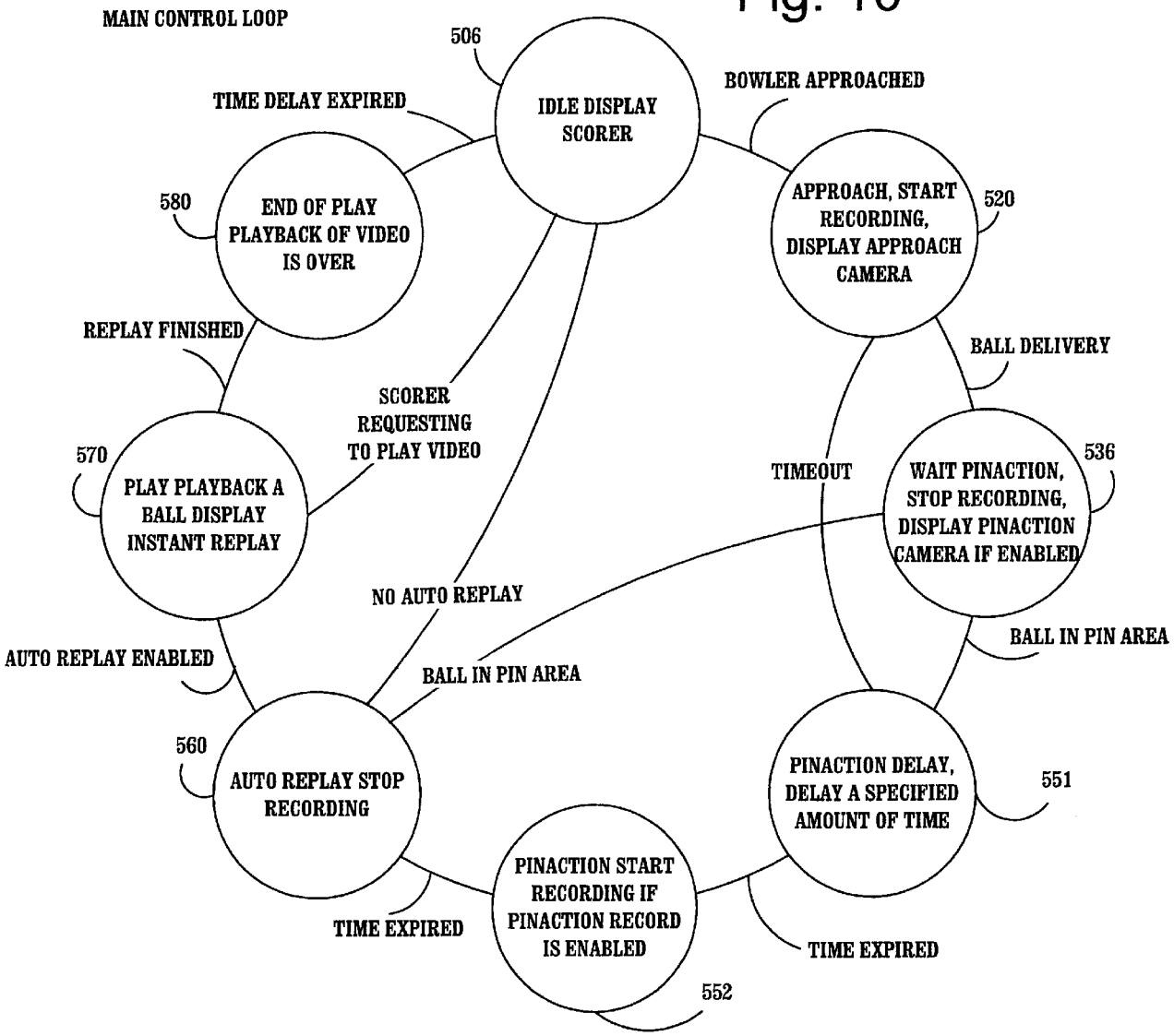
FIG. 10 is a state diagram illustrating the various operational states of the instant replay processor 110 and the flow from one state to another.

Having described the hardware components of the system in detail and having generally described the functions of these components, the overall detailed operation of the instant replay host processor 110 is described below with reference to FIGS. 10 and 11.

The process begins when the system is powered up and the software of processor 110 initializes each of the elements of the system as necessary. It sets up the JPEG chip set with its initial data, the video decoder, and so on and so forth. After the system is initialized, the processor 110 is in an idle loop and the software of processor 110 causes it to function as a software state machine that is primarily interrupt driven. The state diagram for the state machine is shown in FIG. 10 and the more detailed flow of operations within and between states is depicted in the flow diagram of FIGS. 11*a* and 11*b*. In this state machine, state transitions generally correlate to an interrupt occurring.

When processor 110 is in an idle state 506, it checks for a detected approach (step 508, FIG. 11*a*) and if an approach is not detected, processor 110 checks to determine whether there has been a system time-out (step 510). Because no time-out timer will have been set at this point, however, processor 110 will remain in the idle state 506 until an approach is detected in step 508. If a bowler has stepped up and broken the infrared beam that is close to where the bowler picks up his or her ball, an interrupt is generated that the processor 110 recognizes as coming from the approach sensor 160. In response, processor 110 change states by setting a state variable to indicate that the approach state 520 has been entered (step 512). Upon entering the approach state 520, processor 110 instructs DMA controller 360 to begin recording the approach video obtained from the approach area video camera 170 (step 514) and to display the approach video on the display monitor 140 associated with the lane in which the approach was detected (step 516). As explained above, in a recording mode, processor 110 sets up the disk drive 400 in which to store the video by recording the received and compressed video data in the hard disk's circular buffer. Processor 110 then sets up the JPEG CODEC to compress the received video. Also, upon entry of the approach state 520, processor 110 sets a time-out timer in step 518, which is checked during various subsequent operating states.

Figure 11A:
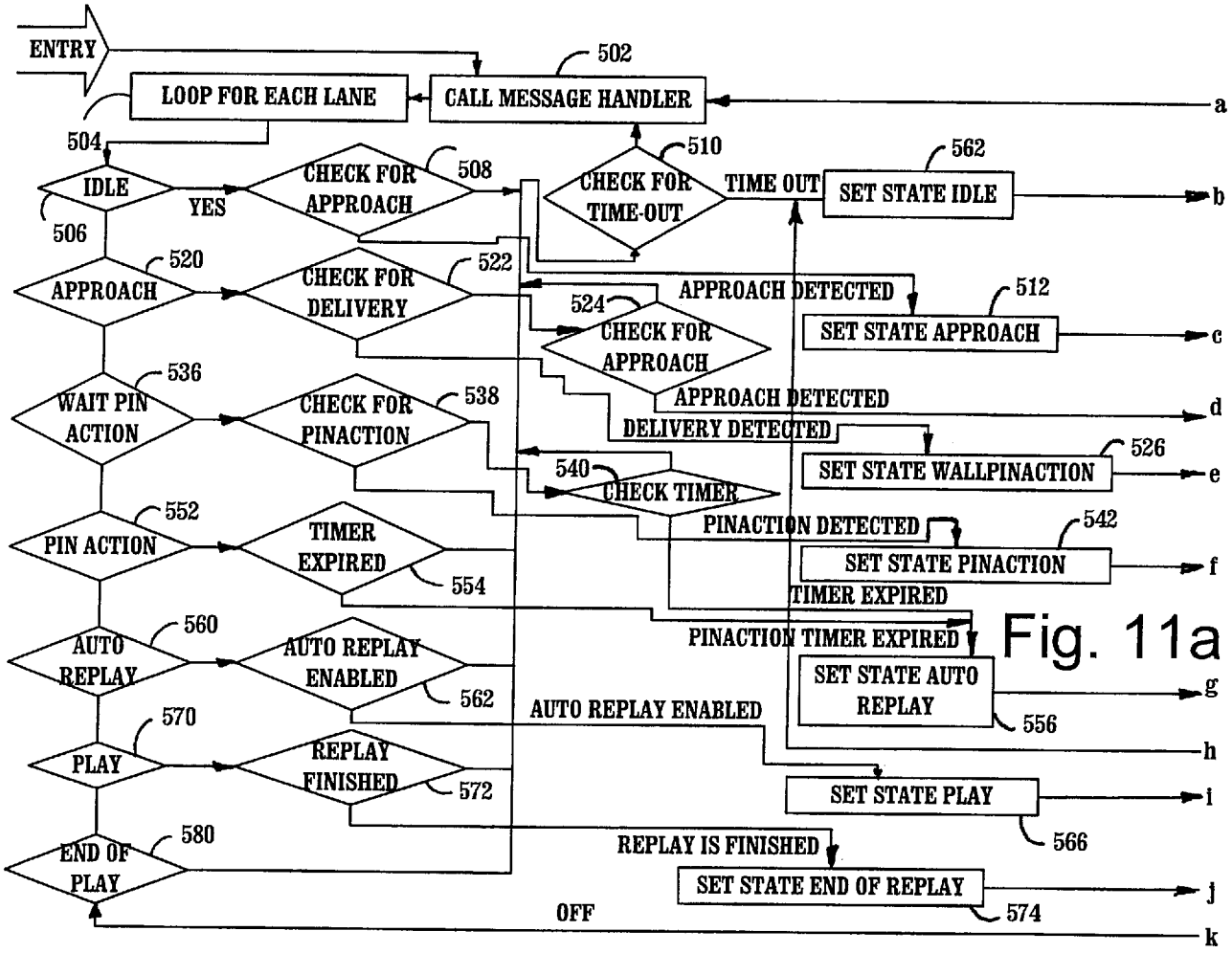
FIGS. 11*a* and 11*b* are a flow diagram illustrating the more detailed operations of the instant replay processor 110 in the various states depicted in FIG. 10.
Figure 11B:
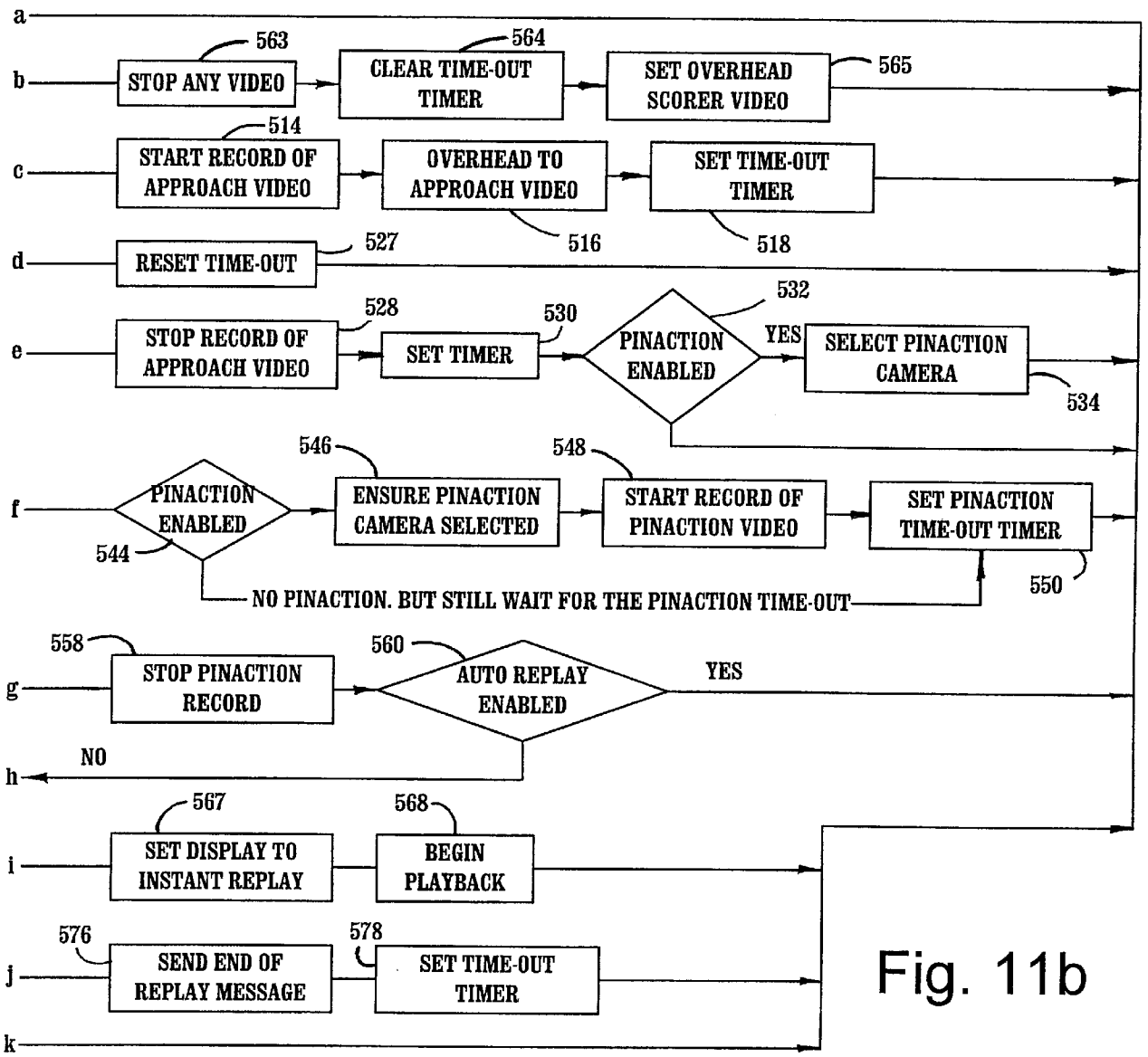

Now, each time processor 110 loops through the flow diagram of FIGS. 11*a* and 11*b* it will pass through the decision block 506 representing the idle state and proceed to the decision block representing the current operational state. Thus, at this point, the processor 110 will proceed to block 520 representing the approach state and will then advance to step 522 where processor 110 will check to see if the ball has been delivered. In the meantime, DMA controller 360 continues to record the approach video into the circular buffer on the disk drive. If the ball has not yet been delivered, processor 110 determines whether the time-out timer set in step 518 has lapsed (step 510). If the bowler crosses the approach area, the time-out timer is reset in step 526. Until the approach, the system will always be recording into the circular buffer. The circular buffer may store an amount of video data corresponding to an adjustable predetermined time period, such as five seconds, so that only the most recent five seconds of approach video are stored in circular buffer at any one time.

When the bowler then decides to roll the bowling ball (i.e., deliver the bowling ball), the system detects (step 522) the delivery by the first ball detector 162 that is placed somewhere down the bowling lane. As the ball crosses through that first ball detector 162, an interrupt is generated and that interrupt tells the processor 110 that the ball has passed through the delivery sensor. At that point, processor 110 enters the wait pin action state (step 526) and stops the recording of the approach (step 528) so that, if five seconds of record time were allocated for the approach and delivery, the system records over and over and over this video in the circular buffer until the ball is detected by the first ball detector 162. Then the data in the circular buffer is stored to the disk at the address designated by processor 110 along with the appropriate ID tags, which identify the bowler, the frame, the ball within the frame, and the game. Thus, only the five seconds of time prior to the ball being detected by the first ball detector 162 is recorded.

Also, upon entering the wait pin action state, processor 110 sets a timer (step 530) and determines whether pin action has been enabled (step 532) (pin action may be disabled if the system is implemented with only an approach area camera and no pin area camera). If pin action is enabled, the pin area camera 175 video signal is delivered to the display monitor associated with the lane and the approach area camera 170 is deactivated (step 534). Preferably, when the video signal provided to the display monitor 140 changes from the approach video to the pin action video, a black video image is intermediately applied to the display monitor 140 via multiplexer 354 to ensure a smooth transitional appearance.

If the pin action camera 175 is disabled, then the approach camera 170 is left on and the approach signal continues to be fed to the display monitor. In either case, processor 110 proceeds to step 536 and then to step 538 to check whether the ball has been detected by the second ball detector 164 located further down the lane. If the ball has not crossed detector 164, processor 110 checks whether the timer, which is sent in step 530, has lapsed (step 540). If the timer has lapsed, processor 110 enters the auto replay state (step 556) otherwise it remains in the wait pin action state until the time-out timer lapses. Thus, if there is no pin camera 175, there is no need to record the pin-fall, so the processor 110 waits for some programmed period of time, and after that period of time has lapsed, then processor 110 begins to initiate a replay. Because the other possibility is if, in fact, the pin action is enabled, then there is a period of time between the ball having passed through the first delivery ball sensor 162 through the time that it is detected by the second ball detector 164 further down the lane and during that period of time nothing is recorded.

When the ball is detected by the second ball detector 164, processor 110 sets its operational state to the pin action state in step 542 unless a delay has been set causing processor 110 to first go from the wait pin action state to the pin action delay state 551. If a delay has been set, processor 110 waits for a predetermined time period after the time the ball has been detected by the second ball detector 164 before moving to the pin action state 552. By setting the delay, disk drive space may be conserved by waiting for the ball to get closer to the pins and into the view of the pin camera 175 before recording is resumed.

After the pin action state has been set in step 542, processor 110 determines whether pin action is enabled (step 544). If it has not been enabled, processor 110 advances to step 550. If pin action is enabled, processor 110 checks to ensure that the signal from the pin action area camera 175 is selected (step 546) and instructs DMA controller 360 to begin recording the video from the pin action area camera 175 (step 548). Then, in step 550, processor 110 sets a pin action time-out timer prior to looping back through the state blocks to block 552 representing the pin action state. Now the way processor 110 transitions from the pin action state 552 to the next state is a little different from the approach method where a detection by a ball detector 162 would actually stop the recording. For the pin action state 552, processor 110 sets up a time delay (step 550), which is adjustable, and at the end of that time delay (step 554), processor 110 transitions from the pin action state 550 to the auto replay state 560 (step 556). The reason a timer is utilized is because there is no mechanism used that informs processor 110 when the pin-fall is completed.

After processor 110 sets itself to the auto replay state in step 556, it stops recording of the pin action area camera video signal (step 558) and determines whether auto replay has been enabled (step 560). The auto replay function, if enabled, automatically replays the recorded video a predetermined time after recording is terminated for that rolled ball. The auto replay state is the same state mentioned above about transitioning to and from the wait pin action state if the pin action is disabled. Thus, there are two paths that go to auto replay state 560.

If auto replay is not enabled or if the time-out timer is found to have expired in step 510, processor 110 returns to the idle state 506 (step 562), stops any on-going video recording (step 563), clears the time-out timer (step 564), and selects the score sheet signal for display on the display monitor using multiplexer 354 (step 565). If auto replay is enabled, processor 110 sets the operational state to the play state 570 (step 566), selects the signal for display on display monitor from the instant replay board 200 (step 567), and instructs DMA controller to begin playback of the video at the designated address (step 568).

The play state 570 can be reached by one of two methods. If the system was in auto replay, then processor 110 immediately goes to the play state where the video is played back at a fixed speed. If processor 110 is in an idle state, and an interrupt message is received (step 502) from the scoring system that instructs processor 110 to play a particular recorded video segment in the designated playback mode, then processor 110 transitions to the play state 570 directly from the idle state. In either case, when processor 110 is in the play state, some video is going to be played back and processor 110 will set the disk drive to playback, it will set the JPEG chip set 220 to go into the decompression mode, and it will set the DMA controller 360 to effect that transfer one field at a time. So, in that manner, the play state displays an instant replay.

When the play state is entered from the idle state in response to a user request entered at the scoring console, the message sent to processor 110 will include a designation of what bowler, game, frame, and ball to replay and a command for how to play it back. One of the commands is "play normal" so that the playback request could be a play normal request, or it could be a play slow request, in which case the actual speed is part of the request data structure that gets sent. Also, processor 110 will look for commands from the scoring system console instructing it to pause or stop playback of a video currently being replayed, or to rewind or fast-forward the video segment.

Figure 12:
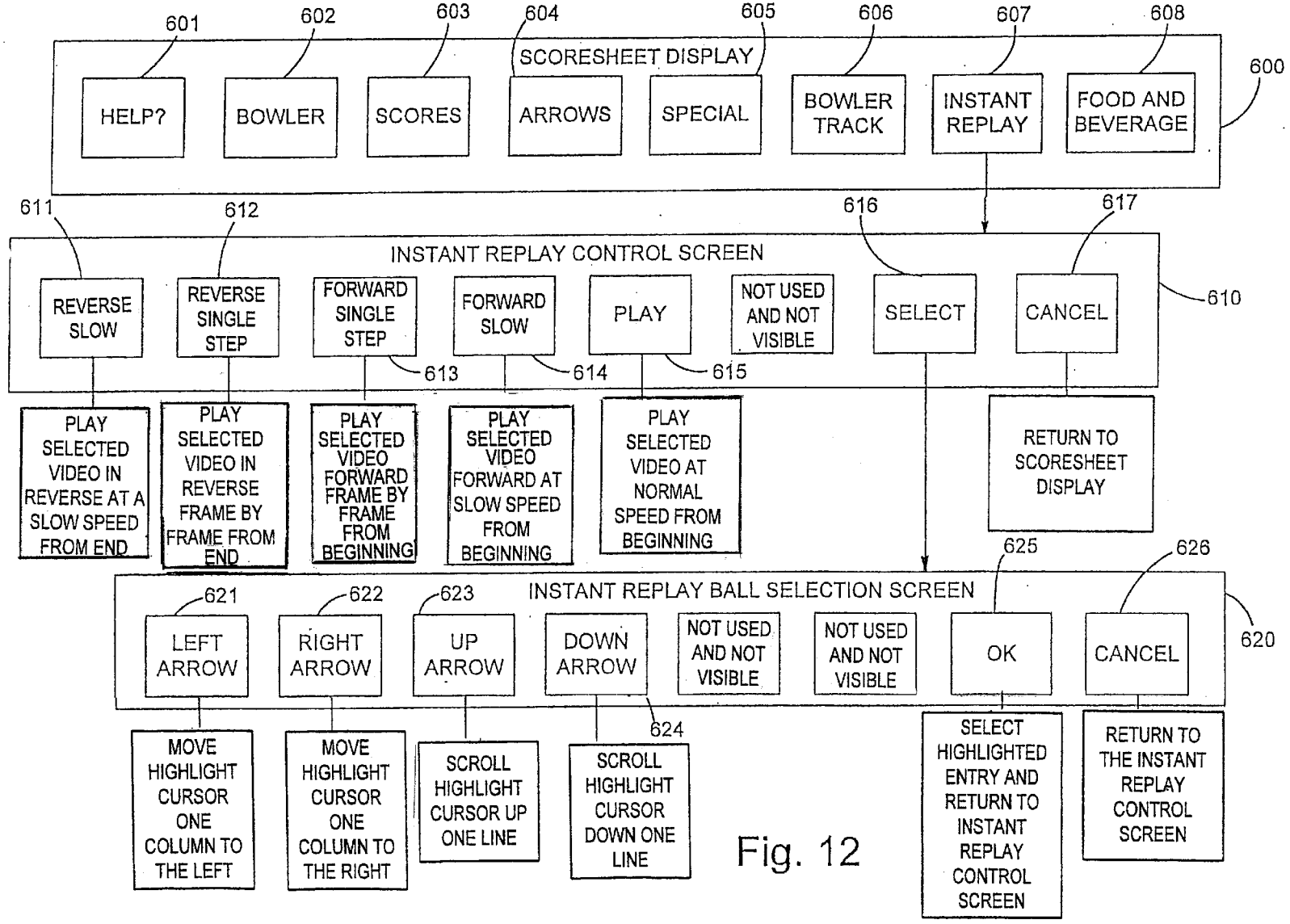
FIG. 12 is a diagram of the input structure for the "instant replay" function.

To enter requests on a scoring system console having soft-keys, the user would first press a key or touch a portion 607 (FIG. 12) of the console score sheet display screen 600 associated with the displayed soft-key 68*g* (FIGS. 5 and 6) indicating "Instant Replay." When the instant replay key 607 on the main score sheet display is actuated, the last recorded video segment is replayed on one of the display monitors and a set of soft-keys corresponding to an instant replay control screen 610 are displayed across the bottom of the display monitor. The instant replay control screen 610 includes a reverse slow soft-key 611, a reverse single step soft-key 612, a forward single step soft-key 613, a forward slow soft-key 614, a play soft-key 615, a select soft-key 616, and a cancel soft-key 617. When the reverse slow soft-key 611 is actuated, the system plays either the last recorded video segment or a selected video segment in reverse at a slow speed starting from the end of that video segment. If reverse single step soft-key 612 is actuated, the system plays the last recorded segment or a selected video segment in reverse frame by frame starting from the end of the video segment. If forward single step soft-key 613 is actuated, the system plays the current video segment or a selected video segment in a forward direction frame by frame starting from the beginning of the segment. If forward slow soft-key 614 is actuated, the system responds by playing either a selected video segment or the current video segment forward at a slow speed starting at the beginning of the video segment. If play soft-key 615 is actuated, the system responds by playing the current video segment or a selected video segment back at normal speed starting from the beginning of the segment. If cancel soft-key 617 is actuated, the system returns to score sheet display 600 to display a screen similar to that shown in FIGS. 5 and 6. If selected soft-key 616 is actuated, the system responds by displaying an instant replay ball selection screen 620. It will be appreciated by those skilled in the art, that other soft-keys may be provided to manipulate the video segment including, for example, a fast-forward soft-key, a rewind soft-key, a pause soft-key, a stop soft-key, a freeze frame soft-key, or soft-keys that allow the playback rate to be variably adjusted.

Instant replay ball selection screen 620 displays an array listing each ball rolled by a particular bowler for each frame of each game and further displays a set of soft-keys along the bottom of the screen which manipulate a cursor that highlights one of the balls listed in the displayed array. In particular, instant replay ball selection screen 620 includes a left arrow soft-key 621 that moves the highlight cursor one column to the left, a right arrow soft-key 622, which moves the highlight cursor one column to the right, an up arrow soft-key 623 which scrolls the highlight cursor up one line, a down arrow soft-key 624, which scrolls the highlight cursor down one line, an okay soft-key 625, which selects the highlighted entry and returns to the instant replay control screen 610, and a cancel soft-key 626 which returns to the instant replay control screen 610 without selecting a video segment that is different from that which was last recorded. Thus, by manipulating soft-keys 621–624, a user may select a video clip of a particular ball rolled in a particular frame in a particular game by a specified bowler and subsequently cause this video clip to be replayed.

When the replay is finished (step 572), processor 110 transitions from the play state 570 to the end of play state 580 (step 574), sends a message to the scoring system indicating the replay is finished (step 576), and sets the time-out timer in step 578. And then after the time-out timer has lapsed, processor 110 transitions from the end of play state 580 back to the idle state 506 causing the video signal supplied to the display monitor 140 to change back to the score sheet generated by the scoring system.

Although the replay system has been described with respect to use in a particular scoring system, it will be appreciated that the replay system may be used separately or integrated partially or wholly within any other automatic scoring system. One such scoring system is that disclosed in U.S. Pat. No. 5,101,354. Moreover, certain aspects and features of the present invention represent novel improvements to instant replay systems that are implemented independent of a bowling scoring system. Thus, it will be appreciated that various aspects of the invention may be practiced without integration with any form of bowling scoring system.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the Doctrine of Equivalents.

The embodiments of the invention in which an exclusive property or privilege is claimed are defined as follows:

1. An instant replay device for use in a bowling scoring system, said instant replay device comprising:

a video camera for generating video signals representing a video clip of at least a portion of a path travelled by a bowling ball rolled down a lane;

compressing means for receiving the video signals and compressing the video clip;

storing means for storing the compressed video clip;

decompressing means for reading the compressed video clip from said storing means, decompressing the compressed video clip, and for supplying the decompressed video clip to a display monitor of the bowling scoring system; and a controller coupled to said decompressing means and to a user input terminal of the bowling scoring system for receiving a user request signal to replay a video clip and for controlling said decompressing means to read, decompress, and playback the video clip on a display monitor of the bowling scoring system in response to the user request signal.

2. The instant replay device as defined in claim 1, wherein said video camera is an approach area video camera for generating video signals representing a video clip of a bowler's approach, said approach area video camera is directed toward an approach area of the lane so as to provide a view of a bowler's approach.

3. The instant replay device as defined in claim 2 and further including:

an approach area sensor coupled to said controller for sensing the presence of a bowler in an approach area of the bowling lane, wherein said controller is coupled to said approach area video camera, to said compressing means, and to said storing means for initiating filming, compressing, and storing of a video clip when a bowler is first sensed in the approach area.

4. The instant replay device as defined in claim 3 and further including:

a ball sensor coupled to said controller and mounted along the bowling lane for sensing a bowling ball passing thereby, wherein said controller stops the filming, compressing, and storing of said video signals when a bowling ball is sensed by said ball sensor.

5. The instant replay device as defined in claim 2 and further including:

a pin-fall area video camera coupled to said compressing means and to said controller, said pin-fall area video camera is directed toward a pin-fall area of the lane so as to generate video signals representing a video clip of the pin-fall area as a bowling ball passes through the pin-fall area.

6. The instant replay device as defined in claim 5 and further including:

an approach area sensor coupled to said controller for sensing the presence of a bowler in an approach area of the bowling lane, wherein said controller is coupled to said approach area video camera, to said compressing means, and to said storing means for initiating filming, compressing, and storing of a video clip by compressing and storing the video signals generated by said approach area video camera when a bowler is first sensed in the approach area; and a ball sensor coupled to said controller and mounted along the bowling lane for sensing the passing of a bowling ball, wherein said controller stops the filming, compressing, and storing of the video signals generated by said approach area video camera when a bowling ball is sensed by said ball sensor.

7. The instant replay device as defined in claim 6 and further including:

a pin-fall area ball sensor coupled to said controller and mounted along the bowling lane for sensing the passing of a bowling ball, wherein said controller initiates the filming, compressing, and storing of the video signals generated by said pin-fall area video camera when a bowling ball is sensed by said pin-fall area ball sensor.

8. The instant replay device as defined in claim 1 and further including:

a pin-fall area video camera coupled to said compressing means and to said controller, said pin-fall area video camera is directed toward a pin-fall area of the lane so as to generate video signals representing a video clip of the pin-fall area as a bowling ball passes through the pin-fall area.

9. The instant replay device as defined in claim 8 and further including:

a pin-fall area ball sensor coupled to said controller and mounted along the bowling lane for sensing the passing of a bowling ball, wherein said controller initiates the filming, compressing, and storing of the video signals generated by said pin-fall area video camera when a bowling ball is sensed by said pin-fall area ball sensor.

10. An instant replay device for use in a bowling scoring system, said instant replay device comprising:

a pin-fall area video camera directed toward a pin-fall area of a bowling lane so as to generate video signals representing a video clip of the pin-fall area as an actual bowling ball passes through the pin-fall area;

storing means for receiving the video signals and storing the video clip; and a control circuit coupled to said storing means for transferring a video clip from said storing means to a display monitor of the bowling scoring system to playback the video clip in response to a user request signal received from an input terminal of the bowling scoring system.

11. The instant replay device as defined in claim 10 and further including:

a pin-fall area ball sensor coupled to said control circuit and mounted along the bowling lane for sensing the passing of a bowling ball, wherein said control circuit initiates the filming and storing of the video signals generated by said pin-fall area video camera when a bowling ball is sensed by said pin-fall area ball sensor.

12. The instant replay device as defined in claim 10 and further including:

an approach area video camera coupled to said storing means and to said control circuit for generating video signals representing a video clip of a bowler's approach and supplying the video signals to said storage means in response to a command from said control circuit, said approach area video camera being mounted above a lane and directed toward an approach area of the lane so as to provide a head-on field of view of a bowler's approach.

13. The instant replay device as defined in claim 12 and further including:

an approach area sensor coupled to said control circuit for sensing the presence of a bowler in an approach area of the bowling lane, wherein said control circuit is coupled to said approach area video camera and to said storing means for initiating filming and storing of a video clip by storing the video signals generated by said approach area video camera when a bowler is first sensed in the approach area; and a ball sensor coupled to said control circuit and mounted along the bowling lane for sensing the passing of a bowling ball, wherein said control circuit stops the filming and storing of the video signals generated by said approach area video camera when a bowling ball is sensed by said ball sensor.

14. An instant replay device for use in a bowling scoring system, said instant replay device comprising:

a video camera for generating video signals representing a video clip of at least a portion of a path taken by an actual bowling ball rolled down a bowling lane;

storing means for receiving the video signals and storing the video clip; and a controller coupled to a user input terminal of a bowling scoring system for receiving a user request signal to replay a video clip and for transferring the video clip from said storing means to playback the video clip in a selected manner on a display monitor of the bowline scoring system in response to the user request signal received from a user input terminal of the bowling scoring system.

15. The instant replay device as defined in claim 14, wherein said controller includes means for transferring the video clip from said storing means at a rate slower than a rate at which the video clip was recorded in response to a user request signal to playback the video clip forward in slow motion.

16. The instant replay device as defined in claim 14, wherein said controller includes means for transferring the video clip from said storing means in reverse at a rate slower than a rate at which the video clip was recorded in response to a user request signal to playback the video clip in slow motion reverse.

17. The instant replay device as defined in claim 14, wherein said controller includes means for transferring the video clip from said storing means video frame by video frame in reverse order at a rate slower than a rate at which the video clip was recorded in response to a user request signal to playback the video clip in reverse frame by frame.

18. The instant replay device as defined in claim 14, wherein said controller includes means for transferring the video clip from said storing means video frame by video frame at a rate slower than a rate at which the video clip was recorded in response to a user request signal to playback the video clip forward frame by frame.

19. The instant replay device as defined in claim 14, wherein a user input terminal of the bowling scoring system displays soft-keys on a scoring console of the bowling scoring system, wherein a set of said soft-keys corresponds to predefined user requests relating to playback of a video clip.

20. The instant replay device as defined in claim 14 and further including:

compressing means for receiving the video signals from said video camera and compressing the video clip prior to storing in said storing means; and decompressing means coupled to said storing means for decompressing the video clip prior to playback.

21. The instant replay device as defined in claim 14, wherein said video camera is a pin-fall area video camera directed toward a pin-fall area of the lane so as to generate video signals representing a video clip of the pin-fall area as a bowling ball passes through the pin-fall area.

22. An instant replay device for a bowling center, said instant replay device comprising:

a video camera for generating video signals representing a plurality of video clips, each video clip including a video image of at least a portion of a path travelled by an actual bowling ball rolled down a lane;

storing means for receiving the video signals and storing each of the video clips in separately addressable memory locations;

a user input terminal for receiving a user request to playback a selected one of the stored video clips;

a display monitor for displaying the selected video clip; and a controller coupled to said display monitor, to said storing means, and to said user input terminal for receiving a user request signal to replay the selected video clip, for identifying the addressable memory location in said storage means corresponding to the selected video clip, and for transferring the selected video clip from said storing means to said display monitor to playback the selected video clip on said display monitor in response to the user request signal.

23. The instant replay device as defined in claim 22 and further including memory means coupled to said controller for maintaining a correspondence between each video clip identified by bowler, frame, and ball rolled, and the addressable memory locations where the video clip is stored to allow a user to select a video clip to replay by entering an identification of the bowler, frame, and ball rolled into said user input terminal.

24. The instant replay device as defined in claim 23, wherein said memory means further identifies each video clip by game to allow a user to select a video clip to replay from any previously bowled game.

25. The instant replay device as defined in claim 23 and further including an interface coupled to said memory means and to a bowling scoring system of the bowling center for automatically receiving an identification of the bowler, frame and ball rolled for each video clip stored in said storage means.

26. The instant replay device as defined in claim 22, wherein said controller includes means for transferring the selected video clip from said storing means at a rate slower than a rate at which the video clip was recorded in response to a user request signal to playback the video clip forward in slow motion.

27. The instant replay device as defined in claim 22, wherein said controller includes means for transferring the selected video clip from said storing means in reverse at a rate slower than a rate at which the video clip was recorded in response to a user request signal to playback the video clip in slow motion reverse.

28. The instant replay device as defined in claim 22, wherein said controller includes means for transferring the selected video clip from said storing means video frame by video frame in reverse order at a rate slower than a rate at which the video clip was recorded in response to a user request signal to playback the video clip in reverse frame by frame.

29. The instant replay device as defined in claim 22, wherein said controller includes means for transferring the selected video clip from said storing means video frame by video frame at a rate slower than a rate at which the video clip was recorded in response to a user request signal to playback the video clip forward frame.

30. The instant replay device as defined in claim 22, wherein said user input terminal displays soft-keys on a scoring console of a bowling scoring system, wherein a set of said soft-keys corresponds to predefined user requests relating to playback of a video clip.

31. The instant replay device as defined in claim 22 and further including:

compressing means for receiving the video signals from said video camera and compressing the video clips prior to storing in said storing means; and decompressing means coupled to said storing means for decompressing the selected video clip prior to playback.

32. The instant replay system as defined in claim 22, wherein said video camera is a pin-fall area video camera directed toward a pin-fall area of the lane so as to generate video signals representing a video clip of the pin-fall area as a bowling ball passes through the pin-fall area.

33. An instant replay device for a bowling center, said instant replay device comprising:

a video camera for generating video signals representing a video clip of at least a portion of a path travelled by an actual bowling ball rolled down a lane;

storing means for receiving video signals and storing a video clip;

an input terminal for receiving operator requests;

transfer means for transferring a received video clip to a portable storage medium; and a control circuit coupled to said storing means, to said transfer means, and to said input terminal for transferring a video clip from said storing means to said transfer means for subsequent transfer to a portable storage medium in response to an operator request signal received from said input terminal.

34. The instant replay device as defined in claim 33, wherein said transfer means is a video cassette recorder for transferring a video clip to a video cassette tape serving as a portable storage medium.

35. The instant replay device as defined in claim 33, wherein said input terminal is a user input terminal provided on a scoring console of a bowling scoring system, and wherein a user may request that a video clip be transferred to a portable storage medium by entering a user request at the scoring console.

36. The instant replay device as defined in claim 33, wherein a plurality of video clips are stored in said storing means, and wherein a user may select one or more of said stored video clips to be transferred to a portable storage medium.

37. An instant replay device for a bowling center, said instant replay system comprising:

a video camera for generating video signals representing a video clip of at least a portion of a path traversed by an actual bowling ball rolled down a lane;

storing means for receiving video signals and storing a video clip;

an input terminal for receiving operator requests;

a printer for printing a received video frame on paper; and a control circuit coupled to said storing means, to said printer, and to said input terminal for transferring a video frame of a stored video clip from said storing means to said printer for subsequent printing in response to an operator request signal.

38. The instant replay device as defined in claim 37, wherein said printer is a color printer for printing a received video frame in color.

39. The instant replay device as defined in claim 37, wherein said input terminal is a user input terminal provided on a scoring console of a bowling scoring system, and wherein a user requests that a video frame be printed by entering a user request at the scoring console.

40. The instant replay device as defined in claim 37, wherein a plurality of video frames of a video clip are stored in the storing means, and wherein a user may select one of said video frames to be printed by said printer.

41. An instant replay network for a bowling center having a plurality of bowling lanes, said instant replay network comprising:

a network communication line; and a plurality of instant replay devices each associated with at least one bowling lane, each instant replay device including:

a network interface coupled to said network communication line for transferring signals from the instant replay device over said network communication line;

a video camera for generating video signals representing a video clip of at least a portion of a path taken by an actual bowling ball rolled down an associated bowling lane;

a memory device coupled to said video camera for receiving the video signals therefrom and for storing the video clip;

a display monitor for displaying the video clip; and a controller coupled to said memory device, to said display monitor, and to said network interface for transferring the video clip from said memory device to said display monitor for display on said display monitor.

42. The instant replay network as defined in claim 41, wherein each instant replay device is associated with a pair of bowling lanes.

43. The instant replay network as defined in claim 41, wherein each instant replay device further includes a user input terminal coupled to said controller for receiving user requests, wherein said controller performs predetermined operations in response to user request signals received from said user input terminal.

44. The instant replay network as defined in claim 43, wherein said user input terminal is a user input terminal of a bowling scoring system that is used to input bowler information into said scoring system.

45. The instant replay system network as defined in claim 41 and further including:

a video server coupled to said network communication line for receiving video signals representing a video frame of a video clip from one of said instant replay devices; and a printer coupled to said video server for printing the received video frame on paper.

46. The instant replay network as defined in claim 45, wherein said printer is a color printer for printing the received video frame in color.

47. The instant replay network as defined in claim 41 and further including:

a video server coupled to said network communication line for receiving video signals representing at least one video clip from one of said instant replay devices; and a video cassette recorder coupled to said video server for transferring the video clip to a video cassette tape.

48. The instant replay network as defined in claim 47, wherein each instant replay device further includes a user input terminal coupled to said controller for receiving user requests, wherein said controller transfers a video clip to said video server in response to a user request signal received from a user input terminal.

49. The instant replay network as defined in claim 48, wherein a plurality of video clips are stored in each memory device means, and wherein a user selects one or more of the stored video clips to be transferred to said video server.

50. The instant replay network as defined in claim 41 and further including a central controller coupled to said network communication line for receiving signals from, and transmitting signals to, any one or more of said instant replay devices.

51. The instant replay network as defined in claim 50 and further including an operator input terminal coupled to said central controller for receiving operator requests, wherein said central controller performs a specified operation in response to an operator request signal received from said operator input terminal.

52. The instant replay network as defined in claim 50, wherein said central controller performs a specified operation in response to a request signal received from one of said instant replay devices.

53. The instant replay network as defined in claim 50, wherein said central controller transfers video clips between said instant replay devices in response to a received request signal.

54. The instant replay network as defined in claim 41, wherein each instant replay system further includes a video switch coupled to said controller and to said display monitor for coupling to a bowling scoring system and for switching between the video clip transferred by said controller and a score sheet display provided by the bowling scoring system.

55. The instant replay network as defined in claim 41, wherein said video camera is an approach area video camera for generating video signals representing a video clip of a bowler's approach, said approach area video camera is directed toward an approach area of the associated bowling lane so as to provide a head-on field of view of a bowler's approach.

56. The instant replay network as defined in claim 55, wherein each instant replay device further includes:

an approach area sensor coupled to said controller for sensing the presence of a bowler in an approach area of the associated bowling lane, wherein said controller is coupled to said approach area video camera, and to said memory device for initiating filming and storing of a video clip when a bowler is first sensed in the approach area.

57. The instant replay network as defined in claim 56, wherein each instant replay device further includes:

a ball sensor coupled to said controller and mounted along the associated bowling lane for sensing a bowling ball passing thereby, wherein said controller stops the filming and storing of the video signals when a bowling ball is sensed by said ball sensor.

58. The instant replay network as defined in claim 55, wherein each instant replay system further includes:

a pin-fall area video camera coupled to said memory device and to said controller, said pin-fall area video camera is directed toward a pin-fall area of the lane so as to generate video signals representing a video clip of the pin-fall area as a bowling ball passes through the pin-fall area.

59. The instant replay network as defined in claim 58, wherein each instant replay system further includes:

an approach area sensor coupled to said controller for sensing the presence of a bowler in an approach area of the associated bowling lane, wherein said controller is coupled to said approach area video camera and to said storing means for initiating filming and storing of a video clip by storing the video signals generated by said approach area video camera when a bowler is first sensed in the approach area; and a ball sensor coupled to said controller and mounted along the associated bowling lane for sensing the passing of a bowling ball, wherein said controller stops the filming and storing of the video signals generated by said approach area video camera when a bowling ball is sensed by said ball sensor.

60. The instant replay network as defined in claim 41, wherein each instant replay device further includes:

a pin-fall area video camera coupled to said memory device and to said controller, said pin-fall area video camera is directed toward a pin-fall area of the lane so as to generate video signals representing a video clip of the pin-fall area as a bowling ball passes through the pin-fall area.

61. The instant replay network as defined in claim 60, wherein each instant replay device further includes:

a pin-fall area ball sensor coupled to said controller and mounted along the bowling lane for sensing the passing of a bowling ball, wherein said controller initiates the filming and storing of the video signals generated by said pin-fall area video camera when a bowling ball is sensed by said pin-fall area ball sensor.

* * * * *

UNITED STATES PATENT AND TRADEMARK OFFICE

CERTIFICATE OF CORRECTION

PATENT NO. : 5,842,929
DATED : December 1, 1998
INVENTORS : Erick R. Moody et al.

It is certified that error appears in the above-identified patent and that said Letters Patent is hereby corrected as shown below:

Abstract, line 3, "deliver" should be --delivery--.

Column 5, lines 43 and 45, "ISA bus 38" should be --motherboard bus 38--.

Column 6, line 16, delete "controller" and insert --microcontroller--.

Column 20, claim 4, line 31, "said video" should be --the video--.

Column 22, claim 14, line 7, "bowline" should be --bowling--.

Column 23, claim 29, line 49, after "frame" insert --by frame--.

Column 25, claim 44, line 25, change "said" to --the bowling--.

Column 25, claim 45, line 26, delete "system".

Column 26, claim 58, line 37, change "system" to --device--.

Column 26, claim 59, line 45, change "system" to --device--.

Signed and Sealed this

Thirtieth Day of November, 1999

*Attest:*

*Attesting Officer*

Q. TODD DICKINSON

*Acting Commissioner of Patents and Trademarks*